US011339559B2

(12) United States Patent
Iwaki et al.

(10) Patent No.: US 11,339,559 B2
(45) Date of Patent: May 24, 2022

(54) FLUSH TOILET

(71) Applicant: TOTO LTD., Kitakyushu (JP)

(72) Inventors: Hideo Iwaki, Kitakyushu (JP); Shu Kashirajima, Kitakyushu (JP); Yukari Kawazu, Kitakyushu (JP); Takahiro Hara, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 0 days.

(21) Appl. No.: 17/025,734

(22) Filed: Sep. 18, 2020

(65) Prior Publication Data

US 2021/0095449 A1 Apr. 1, 2021

(30) Foreign Application Priority Data

Sep. 27, 2019 (JP) ..... JP2019-177890

(51) Int. Cl.
*E03D 1/26* (2006.01)
*E03D 5/01* (2006.01)

(52) U.S. Cl.
CPC . *E03D 1/26* (2013.01); *E03D 5/01* (2013.01)

(58) Field of Classification Search
CPC ..... E03D 1/26
See application file for complete search history.

(56) References Cited

U.S. PATENT DOCUMENTS

| | | | | |
|---|---|---|---|---|
| 6,675,399 | B1 * | 1/2004 | Tomita | E03D 3/00 4/420.4 |
| 6,728,976 | B1 * | 5/2004 | Halloran | E03D 1/26 4/417 |
| 6,895,607 | B2 * | 5/2005 | Idota | E03D 1/26 4/420.4 |
| 2019/0169825 | A1 * | 6/2019 | Swart | E03D 1/26 |

FOREIGN PATENT DOCUMENTS

| | | |
|---|---|---|
| JP | 2001-348937 A | 12/2001 |
| JP | 2006-57453 A | 3/2006 |
| JP | 2017-025499 A | 2/2017 |

* cited by examiner

*Primary Examiner* — Christine J Skubinna
(74) *Attorney, Agent, or Firm* — BakerHostetler

(57) ABSTRACT

A flush toilet includes a toilet main body and a tank device, and the tank device includes a storage tank and a tank mounting member to which the storage tank is detachably attached. At a time of attachment of the storage tank to the tank mounting member, an attaching portion of the storage tank is engaged with an attachment-receiving portion of the tank mounting member by the storage tank being lowered onto a base of the tank mounting member from above. Then, when the storage tank is moved in a horizontal direction relative to the tank mounting member, the attaching portion of the storage tank is configured to be fixed to the attachment-receiving portion of the tank mounting member.

10 Claims, 12 Drawing Sheets

FLUSH TOILET

CROSS-REFERENCE TO RELATED APPLICATION

This application claims benefit of priority to Japanese Patent Application No. 2019-177890, filed Sep. 27, 2019, the entire content of which is incorporated herein by reference.

FIELD OF THE INVENTION

The present invention relates to a flush toilet, and more particularly, to a flush toilet for discharging waste by flushing the flush toilet with flush water.

BACKGROUND OF THE INVENTION

Conventionally, as flush toilets for flushing and discharging waste with flush water, those including a toilet washing mechanism capable of washing a toilet main body, and a private part washing mechanism for washing private parts of a person using the toilet are known, as disclosed in Patent Document 1 (Japanese Patent Laid-Open No. 2001-348937) and Patent Document 2 (Japanese Patent Laid-Open No. 2006-57453), for example.

With such conventional flush toilets, the toilet washing mechanism and the private part washing mechanism are incorporated behind the toilet main body, and thus, there is a problem of how to achieve a so-called "low silhouette", which is achieved by designing the entire flush toilet so that the upper end height is reduced as much as possible, so as to attain better designs and a wider range of designs regarding flush toilets of recent years.

Accordingly, with some conventional flush toilets as described above, the toilet washing mechanism is directly connected to a water pipe that supplies flush water from outside and is capable of discharging flush water by opening/closing of a valve, whereby a storage tank for storing flush water used for flushing the toilet is made unnecessary and the overall size of the toilet washing mechanism is reduced.

However, in the case where the storage tank is adopted as a part of the toilet washing mechanism of a conventional flush toilet as described above, there is a problem of how to secure an appropriate tank capacity for flushing the toilet while achieving a low-silhouette toilet.

In the case of achieving a low-silhouette toilet by installing the storage tank behind the toilet main body, an installation space for the storage tank behind the toilet main body is a limited space between the toilet main body and an external wall surface behind the toilet main body (a wall surface of a toilet installation location).

Furthermore, a discharge trap of the toilet main body and peripheral units other than the storage tank are disposed in the installation space for the storage tank behind the toilet main body, and there is a problem of how to secure the tank capacity while effectively using the limited installation space.

Furthermore, at the time of installing the storage tank behind the toilet main body, the external wall surface behind the toilet main body may obstruct the installation task, and there is a problem of how to efficiently install the storage tank and how to securely attach the storage tank to the toilet main body.

Accordingly, the present invention has been made to solve the problems of the conventional art described above, and an object of the present invention is to provide a flush toilet with which a tank may be installed on a toilet main body by effectively using a limited space behind the toilet main body and with which a tank capacity may be secured.

SUMMARY OF THE INVENTION

To solve the problems described above, the present invention is a flush toilet for discharging waste by flushing the flush toilet with flush water, the flush toilet includes a toilet main body including a bowl configured to receive waste, and a discharge trap configured to discharge the waste in the bowl, and a tank device configured to supply flush water to the toilet main body. The tank device includes a storage tank configured to store the flush water to be supplied to the toilet main body, the storage tank being provided behind the toilet main body, and a tank mounting member fixed behind the bowl of the toilet main body, to which an attaching portion of the storage tank is detachably mounted, wherein the tank mounting member includes a base configured to support the storage tank from below, and an attachment-receiving portion that is provided on the base and to which the attaching portion of the storage tank is detachably attached. When the storage tank is mounted to the tank mounting member, the attaching portion of the storage tank is configured to engage with the attachment-receiving portion of the tank mounting member by the storage tank being lowered from above onto the base of the tank mounting member from above, and then the attaching portion of the storage tank is configured to be fixed to the attachment-receiving portion of the tank mounting member by the storage tank being moved horizontally with respect to the tank mounting member.

According to the flush toilet described above, at the time of installing the storage tank of the tank device on the toilet main body, the tank mounting member is first fixed behind the bowl of the toilet main body. Then, the storage tank is attached from above to the tank mounting member that is fixed to the toilet main body.

At this time the attaching portion of the storage tank may be caused to be engaged with the attachment-receiving portion of the tank mounting member by lowering the storage tank onto the base of the tank mounting member from above.

Then, when the storage tank is moved, after engagement, in the horizontal direction relative to the tank mounting member, the attaching portion of the storage tank may be easily positioned and fixed to the attachment-receiving portion of the tank mounting member.

Furthermore, because the attaching portion of the storage tank can be easily positioned relative to the attachment-receiving portion of the tank mounting member simply by moving the storage tank in the horizontal direction relative to the tank mounting member, the number of fixing parts (screw members or the like) to be fixed to each other may be reduced.

Accordingly, a space occupied by an attachment structure, namely, the attaching portion of the storage tank and the attachment-receiving portion of the tank mounting member, may be reduced, and thus, a limited installation space behind the toilet main body, above the floor surface, may be effectively used, and also, the size (capacity) of the storage tank may be made large. Furthermore, because the number of fixing parts is reduced, a construction task is facilitated.

In the present invention, preferably, the discharge trap extends in a front-back direction in a plan view, from an inlet that is connected to the bowl to an outlet behind the bowl, and the storage tank is disposed to surround an upper portion of the discharge trap from both left and right sides and from behind by being horizontally moved in the front-back direction in a state where the attaching portion of the storage tank is engaged with the attachment-receiving portion of the tank mounting member, and then the attaching portion of the storage tank is configured to be fixed to the attachment-receiving portion of the tank mounting member.

According to the flush toilet described above, in a state where the attaching portion of the storage tank is engaged with the attachment-receiving portion of the tank mounting member, horizontally moving the storage tank in the front-back direction relative to the tank mounting member enables the attaching portion of the storage tank to be positioned at a fixable position of the attachment-receiving portion of the tank mounting member while avoiding interference to the discharge trap extending in the front-back direction.

Moreover, the storage tank may be fixed to the tank mounting member in a state where the storage tank is disposed in a manner surrounding an upper portion of the discharge trap from both the left and right sides and from behind, and thus, a space behind the toilet main body may be effectively used as the installation space for the storage tank.

In the present invention, preferably, the attaching portion of the storage tank is configured to be fixed to the attachment-receiving portion of the tank mounting member in a state where a rear surface of the storage tank is disposed close to an external wall surface behind the rear surface by the storage tank being moved rearward in a state where the attaching portion of the storage tank is engaged with the attachment-receiving portion of the tank mounting member.

According to the flush toilet described above, in a state where the attaching portion of the storage tank is fixed to the attachment-receiving portion of the tank mounting member, the rear surface of the storage tank is positioned close to the external wall surface behind the rear surface, and thus, a gap between the rear surface of the storage tank and the external wall surface behind the rear surface may be reduced.

Therefore, the rear surface and a rear end of the storage tank that is installed in the installation space behind the toilet main body may be positioned as rearward (to the external wall surface side) as possible, and an installation space may be secured for the storage tank behind the toilet main body and other peripheral units.

Therefore, the freedom of design of the storage tank may be increased while effectively using the limited space behind the toilet main body, and a large tank capacity may be secured.

On the other hand, for example, at the time of performing a task such as maintenance of the storage tank, the storage tank may be moved forward after releasing fixation between the attaching portion of the storage tank and the attachment-receiving portion of the tank mounting member.

Accordingly, because the rear surface of the storage tank may be separated from the external wall surface on the rear side of the rear surface, the rear surface side of the storage tank may be easily accessed.

Furthermore, because engagement between the attaching portion of the storage tank and the attachment-receiving portion of the tank mounting member is released by pulling the storage tank upward, the storage tank may be removed from the tank mounting member.

The ease of work at the time of maintenance of the storage tank may thus be increased.

In the present invention, preferably, the storage tank has a left-right asymmetrical shape including a large tank section and a small tank section, the large tank section being a large-capacity side of the storage tank that is divided into two at a center in a left-right direction, the small tank section being a small-capacity side of the storage tank that is divided into two at the center in the left-right direction, and the attaching portion of the storage tank is at least a pair of left and right attaching portions, the left and right attaching portions being provided at the large tank section and the small tank section of the storage tank, respectively.

According to the flush toilet described above, because the storage tank has a deformed shape that is left-right asymmetrical, the storage tank may be fixed to the tank mounting member in a state where the storage tank is disposed in a manner surrounding the upper portion of the discharge trap from both the left and right sides and from behind. A space behind the toilet main body may thus be effectively used as the installation space for the storage tank.

Moreover, because the attaching portions of the storage tank are provided at least in a left and right pair at the large tank section and the small tank section of the storage tank, the storage tank may be stably attached to the tank mounting member even though the storage tank has a deformed shape that is left-right asymmetrical.

In the present invention, preferably, the attaching portion of the storage tank and the attachment-receiving portion of the tank mounting member include respective screw-fixing portions that are configured to be screw-fixed to each other after the storage tank is moved in the horizontal direction relative to the tank mounting member in a state where the attaching portion of the storage tank is engaged with the attachment-receiving portion of the tank mounting member.

According to the flush toilet described above, the screw-fixing portions of the attaching portion of the storage tank and the attachment-receiving portion of the tank mounting member may be aligned with each other in advance by the storage tank being moved in the horizontal direction relative to the tank mounting member in a state where the attaching portion of the storage tank is engaged with the attachment-receiving portion of the tank mounting member.

Accordingly, screw-fixing may be accurately performed for the screw-fixing portions that are aligned, and erroneous construction may be avoided.

In the present invention, preferably, the attaching portion of the storage tank and the attachment-receiving portion of the tank mounting member further include respective locking portions configured to be locked to each other after the storage tank is moved rearward relative to the tank mounting member in a state where the attaching portion of the storage tank is engaged with the attachment-receiving portion of the tank mounting member, and then the locking portions are configured to be enable the screw-fixing portions of the attaching portion of the storage tank and the attachment-receiving portion of the tank mounting member to be fixed to each other.

According to the flush toilet described above, the locking portions of the attaching portion of the storage tank and the attachment-receiving portion of the tank mounting member may be locked and fixed to each other by the storage tank being moved rearward relative to the tank mounting member in a state where the attaching portion of the storage tank is engaged with the attachment-receiving portion of the tank mounting member.

Furthermore, locking of the locking portions allows the screw-fixing portions of the attaching portion of the storage tank and the attachment-receiving portion of the tank mounting member to be swiftly and accurately aligned before fixing.

Screw-fixing may thus be swiftly and accurately performed for the screw-fixing portions that are aligned, and thus, the ease of construction may be increased.

In the present invention, preferably, the locking portion of the attachment-receiving portion of the tank mounting member includes a sloping surface whose rear upper surface slopes downward from back to front.

According to the flush toilet described above, even if, at the time of attachment of the attaching portion of the storage tank to the attachment-receiving portion of the tank mounting member from above, a bottom surface of the attaching portion of the storage tank is placed on top of an upper end or the sloping surface of the locking portion of the attachment-receiving portion of the tank mounting member from above, the attaching portion of the storage tank may be caused to move on the sloping surface of the locking portion of the attachment-receiving portion of the tank mounting member from the back to obliquely forward and downward.

The attaching portion of the storage tank may thereby be guided into a range in the attachment-receiving portion of the tank mounting member where engagement is possible, and thus, positioning of the attaching portion of the storage tank relative to the attachment-receiving portion of the tank mounting member may be aided.

In the present invention, preferably, the large tank section includes a rear large tank section disposed behind the discharge trap, a front large tank section that extends forward from the rear large tank section and that is disposed on one of left and right sides of the discharge trap, and a lower large tank section that extends downward from the rear large tank section, the small tank section includes a rear small tank section that is disposed behind the discharge trap, and a front small tank section that extends forward from the rear small tank section and that is disposed on another one of the left and right sides of the discharge trap, a front end of the front large tank section is disposed more forward than a front end of the front small tank section, a bottom surface of the lower large tank section is located below a bottom surface of each of the rear small tank section and the front small tank section, and the attaching portion of the storage tank includes a large tank-side attaching portion that is provided on at least one of the rear large tank section and the front large tank section, and a small tank-side attaching portion that is provided on at least one of the rear small tank section and the front small tank section.

According to the flush toilet described above, the shape of the storage tank is a deformed shape that is left-right asymmetrical because of the rear large tank section, the front large tank section and the lower large tank section of the large tank section of the storage tank and the rear small tank section and the front small tank section of the small tank section of the storage tank. The storage tank with a relatively large capacity may thus be installed in the limited installation space behind the toilet main body.

Furthermore, even with the storage tank having such a deformed shape, the large tank-side attaching portion of the storage tank is provided to at least one of the rear large tank section and the front large tank section, and the small tank-side attaching portion of the storage tank is provided to at least one of the rear small tank section and the front small tank section. Accordingly, each attaching portion of the storage tank may be stably attached to the corresponding attachment-receiving portion of the tank mounting member.

Furthermore, because the shape of the storage tank is a deformed shape that is left-right asymmetrical, each attaching portion of the storage tank may be securely fixed after being positioned at the fixable position of the corresponding attachment-receiving portion of the tank mounting member while avoiding interference to the discharge trap extending in the front-back direction.

In the present invention, preferably, the large tank-side attaching portion and the small tank-side attaching portion of the storage tank and corresponding attachment-receiving portions of the tank mounting member include respective screw-fixing portions configured to be screw-fixed to each other rafter the storage tank is horizontally moved in the front-back direction relative to the tank mounting member in a state where the large tank-side attaching portion and the small tank-side attaching portion are engaged with the corresponding attachment-receiving portions of the tank mounting member.

According to the flush toilet described above, even when the shape of the storage tank is a deformed shape that is left-right asymmetrical, the storage tank may be horizontally moved in the front-back direction relative to the tank mounting member in a state where the large tank-side attaching portion and the small tank-side attaching portion of the storage tank are engaged with the corresponding attachment-receiving portions of the tank mounting member. Accordingly, the screw-fixing portions of each attaching portion of the storage tank and the corresponding attachment-receiving portion of the tank mounting member may be aligned with each other in advance.

Accordingly, screw-fixing may be accurately performed for the screw-fixing portions that are aligned, and erroneous construction may be avoided.

In the present invention, preferably, the large tank-side attaching portion and the small tank-side attaching portion of the storage tank and the corresponding attachment-receiving portions of the tank mounting member further include respective locking portions configured to be locked to each other after the storage tank is moved rearward relative to the tank mounting member in a state where the large tank-side attaching portion and the small tank-side attaching portion are engaged with the corresponding attachment-receiving portions of the tank mounting member, and then the respective locking portions are configured to be enable the screw-fixing portions of each attaching portion of the storage tank and the corresponding attachment-receiving portion of the tank mounting member to be fixed to each other.

According to the flush toilet described above, even when the shape of the storage tank is a deformed shape that is left-right asymmetrical, the locking portions of each attaching portion of the storage tank and the corresponding attachment-receiving portion of the tank mounting member may be locked and fixed to each other by the storage tank being moved rearward relative to the tank mounting member in a state where each attaching portion of the storage tank is engaged with the corresponding attachment-receiving portion of the tank mounting member.

Furthermore, locking of the locking portions allows the screw-fixing portions of each attaching portion of the storage tank and the corresponding attachment-receiving portion of the tank mounting member to be swiftly and accurately aligned before fixing.

Moreover, screw-fixing may be swiftly and accurately performed for the screw-fixing portions that are aligned, and thus, the ease of construction may be increased.

According to the flush toilet described above, the tank may be installed on the toilet main body by effectively using a limited space behind the toilet main body, and a tank capacity may be secured.

DETAILED DESCRIPTION OF THE PREFERRED EMBODIMENT

Hereinafter, a flush toilet according to an embodiment of the present invention will be described with reference to the appended drawings.

Figure 1:
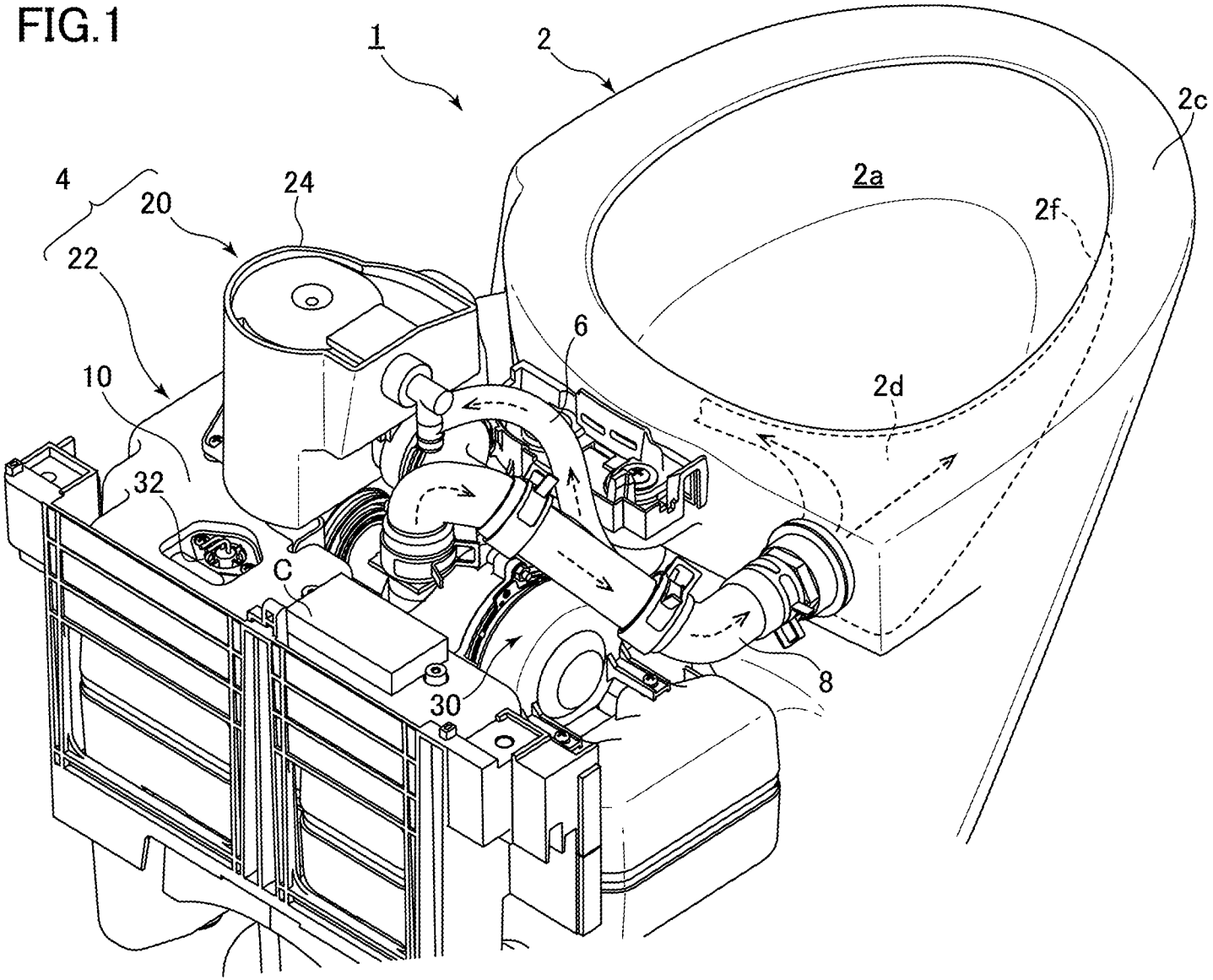
FIG. 1 is a schematic perspective view showing a flush toilet according to an embodiment of the present invention, where the flush toilet is seen obliquely from behind and above.

First, FIG. 1 is a schematic perspective view showing the flush toilet according to the embodiment of the present invention, where the flush toilet is seen obliquely from behind and above. Furthermore, FIG. 2 is an overall configuration diagram of the flush toilet according to the embodiment of the present invention.

Figure 2:
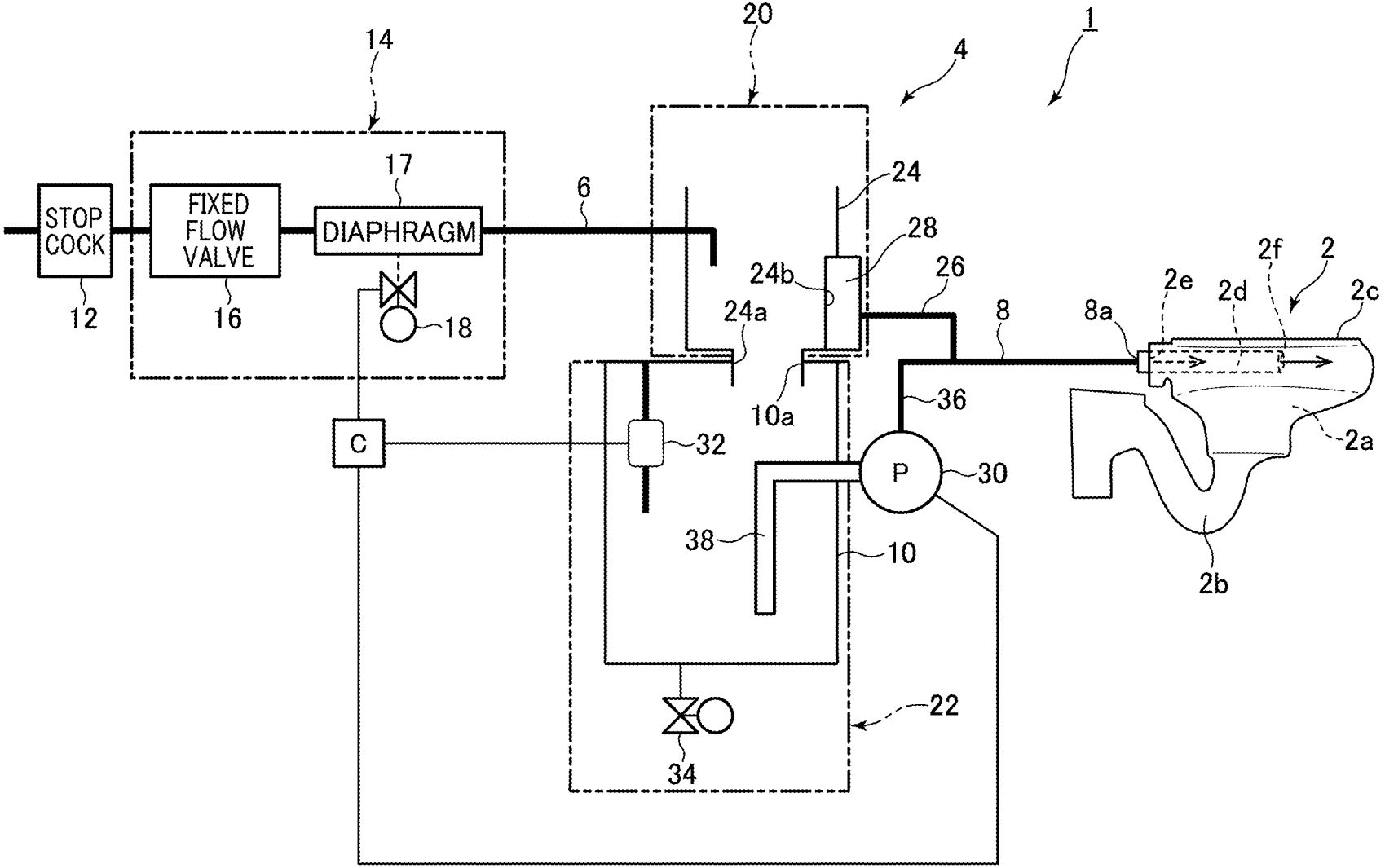
FIG. 2 is an overall configuration diagram of the flush toilet according to the embodiment of the present invention.

As shown in FIGS. 1 and 2, a flush toilet 1 according to the embodiment of the present invention includes a toilet main body 2 made of ceramics, and a tank device 4 that is provided behind the toilet main body 2.

Furthermore, the toilet main body 2 includes a bowl 2*a* for receiving waste, a discharge trap (a discharge trap pipe 2*b*) for discharging waste in the bowl 2*a*, the discharge trap extending from a bottom portion of the bowl 2*a*, and a rim 2*c* formed at a top edge of the bowl 2*a*.

Next, as shown in FIGS. 1 and 2, the tank device 4 includes a water supply pipe 6 and a water discharge pipe 8 that are connected, respectively, on an upstream side and a downstream side of the tank device 4.

An upstream side of the water supply pipe 6 is connected to an external water supply source (not shown) such as a water system. A downstream side of the water supply pipe 6 is connected to a storage tank 10 (of which more later) of the tank device 4. Flush water is thus supplied from the water supply pipe 6 to the storage tank 10.

Furthermore, a stop cock 12 and a valve unit 14 are provided on the water supply pipe 6, from the upstream side to the downstream side.

Moreover, the valve unit 14 includes a fixed flow valve 16 provided on the water supply pipe 6, and an electromagnetic valve 18 for opening/closing an on-off valve (a diaphragm valve 17) provided downstream of the fixed flow valve 16.

Next, as shown in FIGS. 1 and 2, the tank device 4 further includes a connecting unit 20 that is connected downstream of the valve unit 14 of the water supply pipe 6, and a tank unit 22 connected on a downstream side of the connecting unit 20 and including the storage tank 10.

At the valve unit 14, a flow rate of flush water in the water supply pipe 6 is adjusted to be constant by the fixed flow valve 16.

Then, when the electromagnetic valve 18 is electromagnetically opened, and a flow path in the water supply pipe 6 is released by the on-off valve (the diaphragm valve 17), the flush water in the water supply pipe 6 is supplied to the tank unit 22 through the connecting unit 20.

As shown in FIG. 2, the connecting unit 20 includes a water receiving housing 24, an overflow pipe 26, and a check valve 28.

Moreover, a lower opening 24*a* of the water receiving housing 24 is detachably connected to an upper opening 10*a* of the storage tank 10 of the tank unit 22.

The overflow pipe 26 connects an overflow port 24*b* provided in a part of a side wall of the water receiving housing 24 and the water discharge pipe 8.

The water discharge pipe 8 is a connecting pipe (a flush water supply pipe), an upstream side of the water discharge pipe 8 is connected to a pump 30 of the tank device 4, and a downstream side of the water discharge pipe 8 is connected to a rim conduit 2*d* inside the rim 2*c* of the toilet main body 2.

Moreover, the check valve 28 is provided at the overflow port 24*b*, and is capable of allowing flush water in the water receiving housing 24 to flow into the overflow pipe 26 from the overflow port 24*b* while preventing flush water in the overflow pipe 26 from flowing backward into the water receiving housing 24.

Next, as shown in FIG. 2, the tank unit 22 includes the storage tank 10, the pump 30, a float switch 32, a drain plug 34, a controller C and the like.

The pump 30 is provided on a part (midstream) of a water passage pipe 36 connected on an upstream side of the water discharge pipe 8. An upstream end 36*a* of the water passage pipe 36 is connected to a downstream end 38*a* of a suction pipe 38 provided in the storage tank 10.

Flush water stored in the storage tank 10 is suctioned from the suction pipe 38 into the water passage pipe 36 by operation of the pump 30, and is then fed under pressure to the water discharge pipe 8 via the pump 30.

All the flush water that is supplied from the storage tank 10 to the water discharge pipe 8 by the pump 30 is thus supplied into the rim conduit 2*d* from an inlet 2*e* of the rim conduit 2*d*.

Then, the flush water in the rim conduit 2*d* is discharged into the bowl 2*a* from a rim spouting port 2*f* on a downstream end of the rim conduit 2*d*, and toilet flushing (toilet flushing by so-called 100% rim spouting) is thus performed.

That is, the water passage pipe 36 and the water discharge pipe 8 each function as a flush water supply pipe for supplying flush water that is fed under pressure from the storage tank 10 by the pump 30 to the toilet main body 2.

The float switch 32 detects a water level inside the storage tank 10. An opening/closing operation of the electromagnetic valve 18 of the valve unit 14 is controlled by the controller C based on the water level inside the storage tank 10 that is detected by the float switch 32.

Furthermore, the operation of the pump 30 is also controlled by the controller C based on the water level inside the storage tank 10 that is detected by the float switch 32.

For example, in the case where the water level inside the storage tank 10 that is detected by the float switch 32 is at or below a predetermined water level, the electromagnetic valve 18 is opened, the water supply pipe 6 is released, and the pump 30 is caused to operate.

Then, when the water level inside the storage tank 10 reaches the predetermined water level, the electromagnetic valve 18 is closed, the water supply pipe 6 is closed, and the pump 30 is stopped.

The drain plug 34 is provided in a bottom surface of the storage tank 10. In normal use, the drain plug 34 is closed at all times, and the drain plug 34 can be removed as necessary to discharge the flush water in the storage tank 10 to outside.

Next, details of the storage tank 10 of the tank unit 22 will be given with reference to FIGS. 3 to 6.

Figure 3:
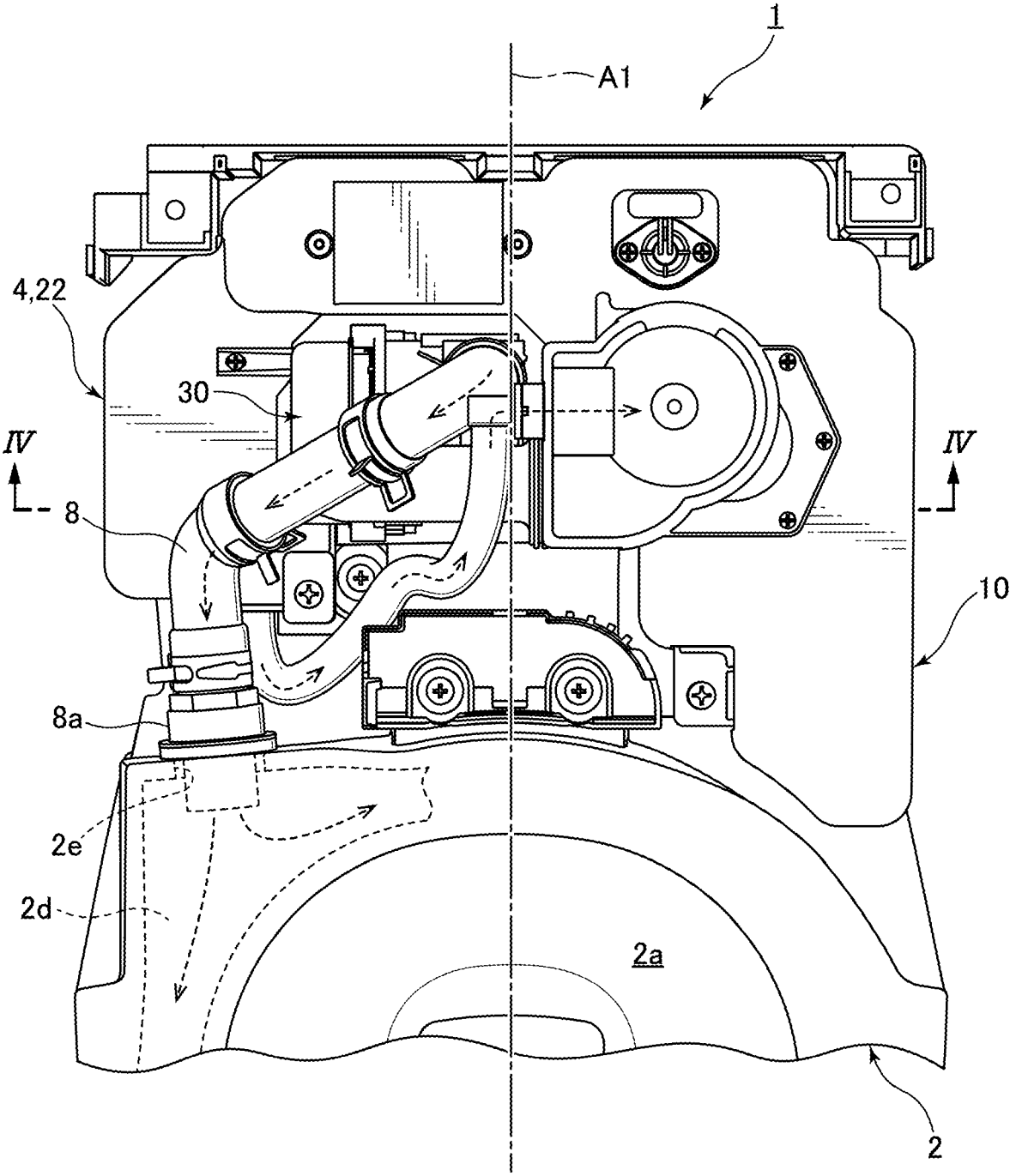
FIG. 3 is an enlarged partial plan view showing a part of the flush toilet according to the embodiment of the present invention in an enlarged manner, the part corresponding to a tank unit.

FIG. 3 is an enlarged partial plan view showing a part of the flush toilet according to the embodiment of the present invention in an enlarged manner, the part corresponding to the tank unit. Furthermore, FIG. 4 is a cross-sectional view taken along a line IV-IV in FIG. 3.

Figure 4:
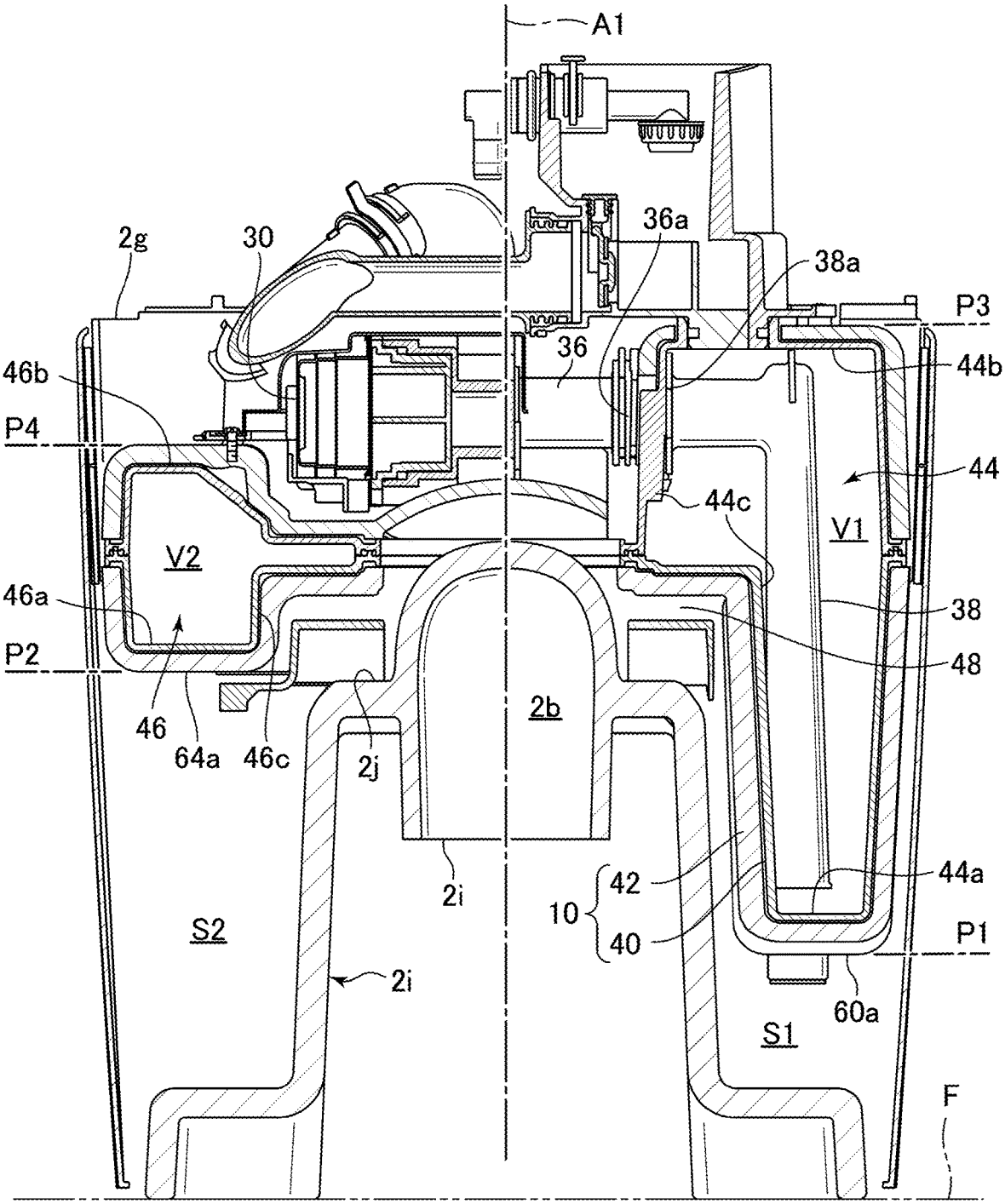
FIG. 4 is a cross-sectional view taken along a line IV-IV in FIG. 3.

First, as shown in FIGS. 3 and 4, the storage tank 10 of the tank unit 22 includes a single tank main body 40, and an antisweat material 42 covering an outside of the tank main body 40.

Figure 5:
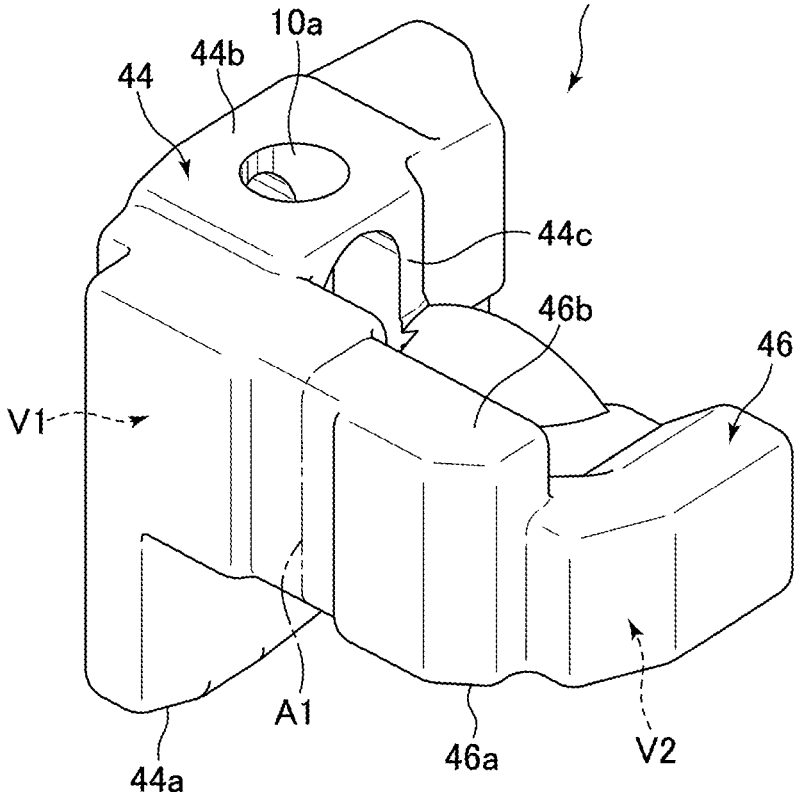
FIG. 5 is a perspective view showing a storage tank of the flush toilet according to the embodiment of the present invention, where the storage tank is seen obliquely from behind and above.

Next, FIG. 5 is a perspective view showing the storage tank of the flush toilet according to the embodiment of the present invention, where the storage tank is seen obliquely from behind and above. Furthermore, FIG. 6 is a rear view of the storage tank of the flush toilet according to the embodiment of the present invention.

As shown in FIGS. 3 to 6, when a virtual vertical plane that divides the storage tank 10 of the tank unit 22 into two at a center in a left-right direction is taken as "vertical plane A1", the single tank main body 40 of the storage tank 10 and the antisweat material 42 on the outside include a large tank section 44 and a small tank section 46 on left and right of the vertical plane A1, and are divided into two in the left-right direction by the vertical plane A1, into the large tank section 44 and the small tank section 46.

Figure 6:
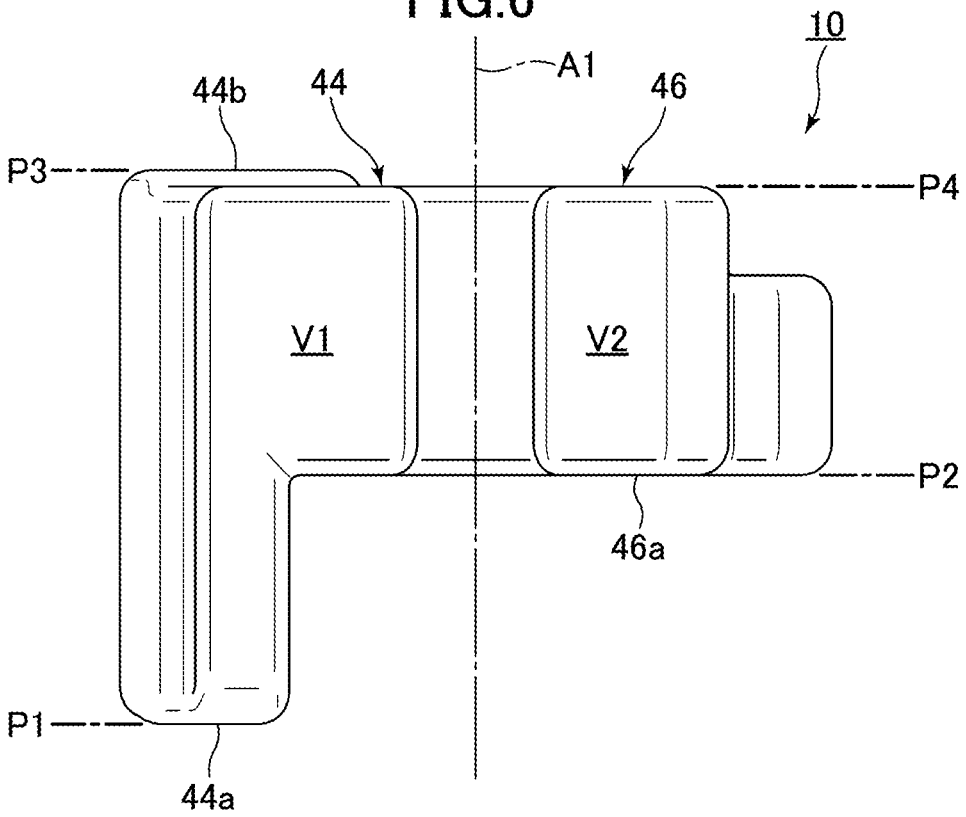
FIG. 6 is a rear view of the storage tank of the flush toilet according to the embodiment of the present invention.

That is, as shown in FIG. 6, when the tank main body 40 and the antisweat material 42 are seen from a rear surface side, the large tank section 44 is disposed on a left side of the vertical plane A1, and when the tank main body 40 and the antisweat material 42 are seen from the rear surface side, the small tank section 46 are disposed on a right side of the vertical plane A1, and a capacity V1 of the large tank section 44 is set greater than a capacity V2 of the small tank section 46 (V1>V2).

Accordingly, because of the large tank section 44 and the small tank section 46, the storage tank 10 has a left-right asymmetrical shape (a deformed shape of an approximately C-shape or U-shape in a plan view).

Next, as shown in FIG. 4, the toilet main body 2 includes, in a region behind the bowl 2*a*, a large-tank housing section S1 and a small-tank housing section S1 for housing the large tank section 44 and the small tank section 46, respectively, at a position higher than a floor surface.

That is, in the region behind the bowl 2*a* of the toilet main body 2, the large-tank housing section S1 is formed on one of left and right sides of the vertical plane A1 that divides the region into two in the left-right direction (on the right side of the vertical plane A1 when the toilet main body 2 is seen from front).

In the region behind the bowl 2*a* of the toilet main body 2, the small-tank housing section S2 is formed on the other one of the left and right sides of the vertical plane A1 (on the left side of the vertical plane A1 when the toilet main body 2 is seen from the front).

Furthermore, as shown in FIGS. 4 to 6, in a state where the large tank section 44 and the small tank section 46 are disposed in the large-tank housing section S1 and the small-tank housing section S2, respectively, a lowest position P1 of a bottom surface 44*a* of the large tank section 44 is located below a lowest position P2 of a bottom surface 46*a* of the small tank section 46.

Furthermore, as shown in FIGS. 4 to 6, in the state where the large tank section 44 and the small tank section 46 are disposed in the large-tank housing section S1 and the small-tank housing section S2, respectively, a position P3 of an upper surface 44*b* of the large tank section 44 is located above a position P4 of an upper surface 46*b* of the small tank section 46 and lower than an upper surface 2*g* of the rim 2*c* of the toilet main body 2.

Additionally, a tank mounting member 48, of which more later, is fixed behind the toilet main body 2, and the storage tank 10 may be attached to the tank mounting member 48 from above. The storage tank 10 may thus be assembled together with the toilet main body 2.

As shown in FIGS. 2 and 4, the suction pipe 38 is provided inside the large tank section 44 of the tank main body 40, and the upstream end 36*a* of the water passage pipe 36 extending on an upstream side (sideways) from the pump 30 is connected to the downstream end 38*a* of the suction pipe 38, that is a part of the large tank section 44, in a watertight manner.

Furthermore, as shown in FIG. 3, an upstream end of the water discharge pipe 8 is connected to a downstream end of the water passage pipe 36 extending on a downstream side (upward) from the pump 30, and a downstream end (an outlet 8*a*) of the water discharge pipe 8 is connected to the inlet 2*e* of the rim conduit 2*d* on the other one of the left and right sides of the vertical plane A1 of the toilet main body 2 (on the left side of the vertical plane A1 when the toilet main body 2 is seen from the front).

Next, as shown in FIG. 4, a side wall surface 44*c* of the large tank section 44, on the side of the vertical plane A1 (at the center in the left-right direction), is positioned inside the large-tank housing section S1 and outward of the discharge trap pipe 2*b* (on the right side when the discharge trap pipe 2*b* is seen from the front).

Likewise, a side wall surface 46*c* of the small tank section 46, on the side of the vertical plane A1 (at the center in the left-right direction), is positioned inside the small-tank housing section S2 and outward of the discharge trap pipe 2*b* (on the left side when the discharge trap pipe 2*b* is seen from the front).

Furthermore, as shown in FIGS. 4 and 5, the discharge trap pipe 2*b* is provided at the center of the toilet main body 2 in the left-right direction, and the upstream end 36*a* of the water passage pipe 36 is connected to the side wall surface 44*c* that is the side surface, of the large tank section 44, on the discharge trap pipe 2*b* side, of left and right side surfaces of the large tank section 44.

Furthermore, as shown in FIGS. 3 and 4, the pump 30 is disposed behind the bowl 2*a* of the toilet main body 2, at a position higher than the discharge trap pipe 2*b*.

Moreover, the pump 30 is disposed in a space between the large tank section 44 and the small tank section 46 in the left-right direction, more to the center of the toilet main body 2 in the left-right direction than the upstream end 36*a* of the water passage pipe 36 and the downstream end (the outlet 8*a*) of the water discharge pipe 8.

Next, a specific description will be given with reference to FIG. 4 and FIGS. 7 to 14, of the tank mounting member 48, mentioned above, that is fixed to the toilet main body 2, and of an attachment structure between an attaching portion T of the storage tank 10 and an attachment-receiving portion U of the tank mounting member 48.

Figure 7:
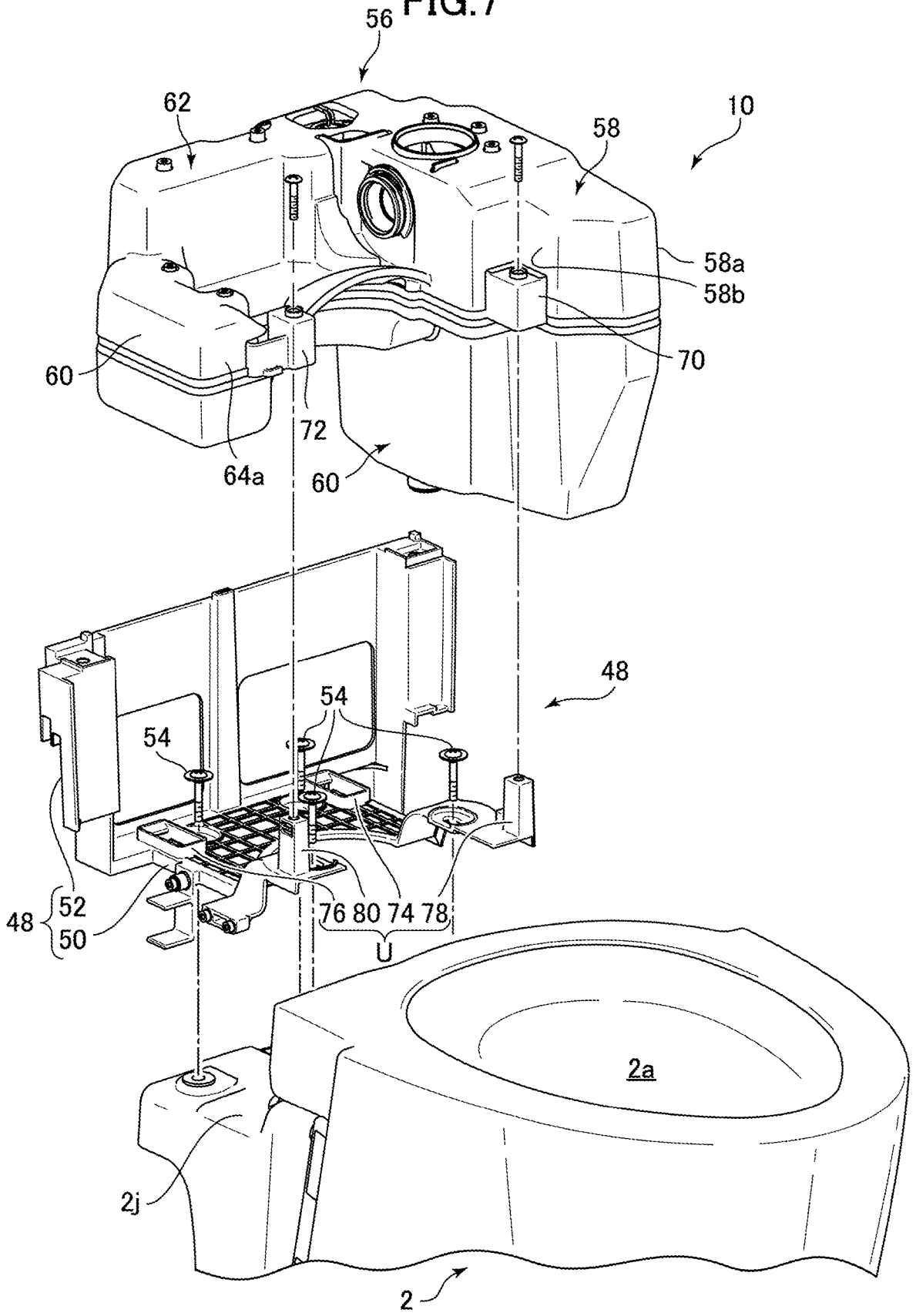
FIG. 7 is an exploded perspective view showing a toilet main body, a tank mounting member, and the storage tank of the flush toilet according to the embodiment of the present invention.

First, FIG. 7 is an exploded perspective view showing the toilet main body, the tank mounting member, and the storage tank of the flush toilet according to the embodiment of the present invention.

Figure 8:
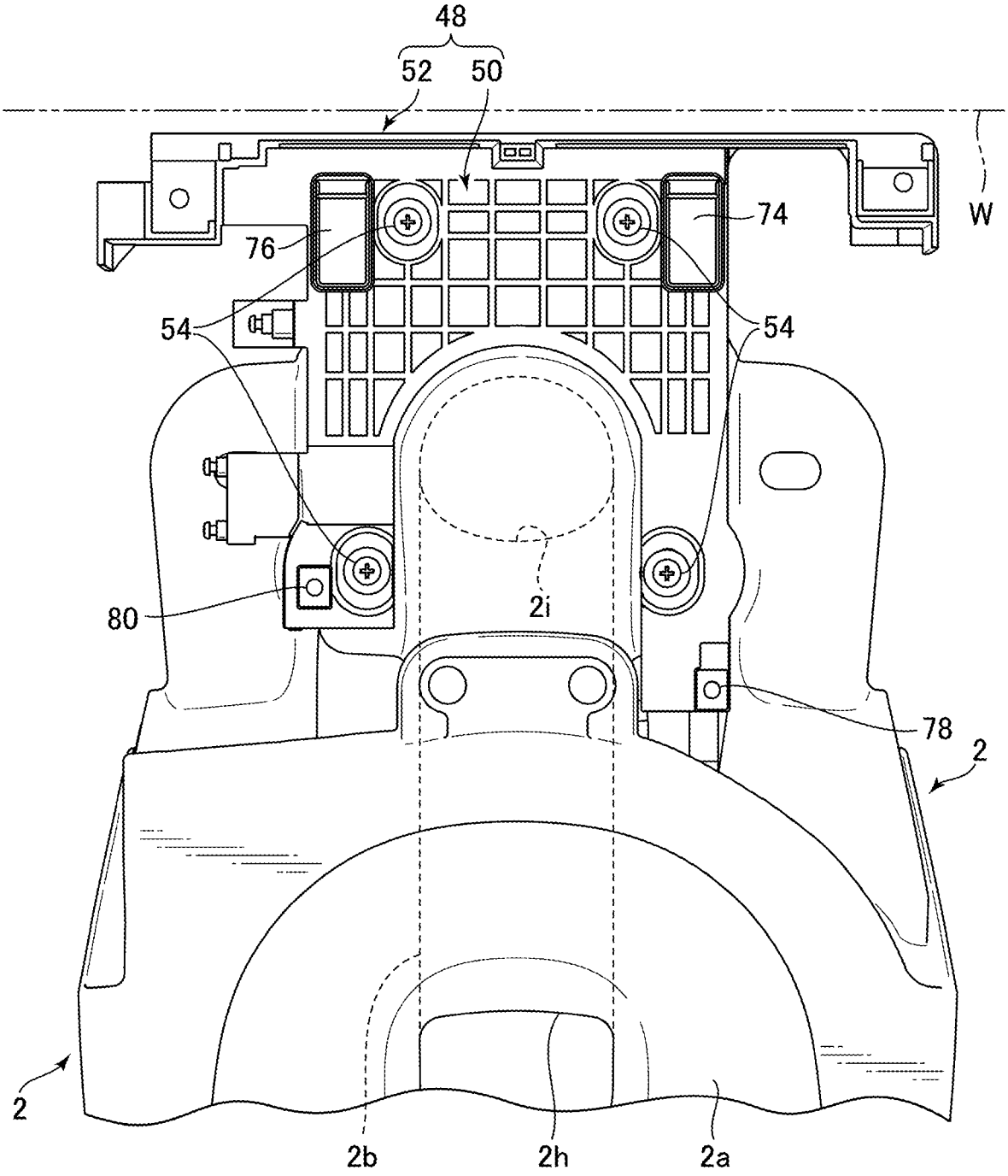
FIG. 8 is a plan view showing a state where the tank mounting member is attached to the toilet main body of the flush toilet according to the embodiment of the present invention.

Furthermore, FIG. 8 is a plan view showing a state where the tank mounting member is attached to the toilet main body of the flush toilet according to the embodiment of the present invention.

Figure 9:
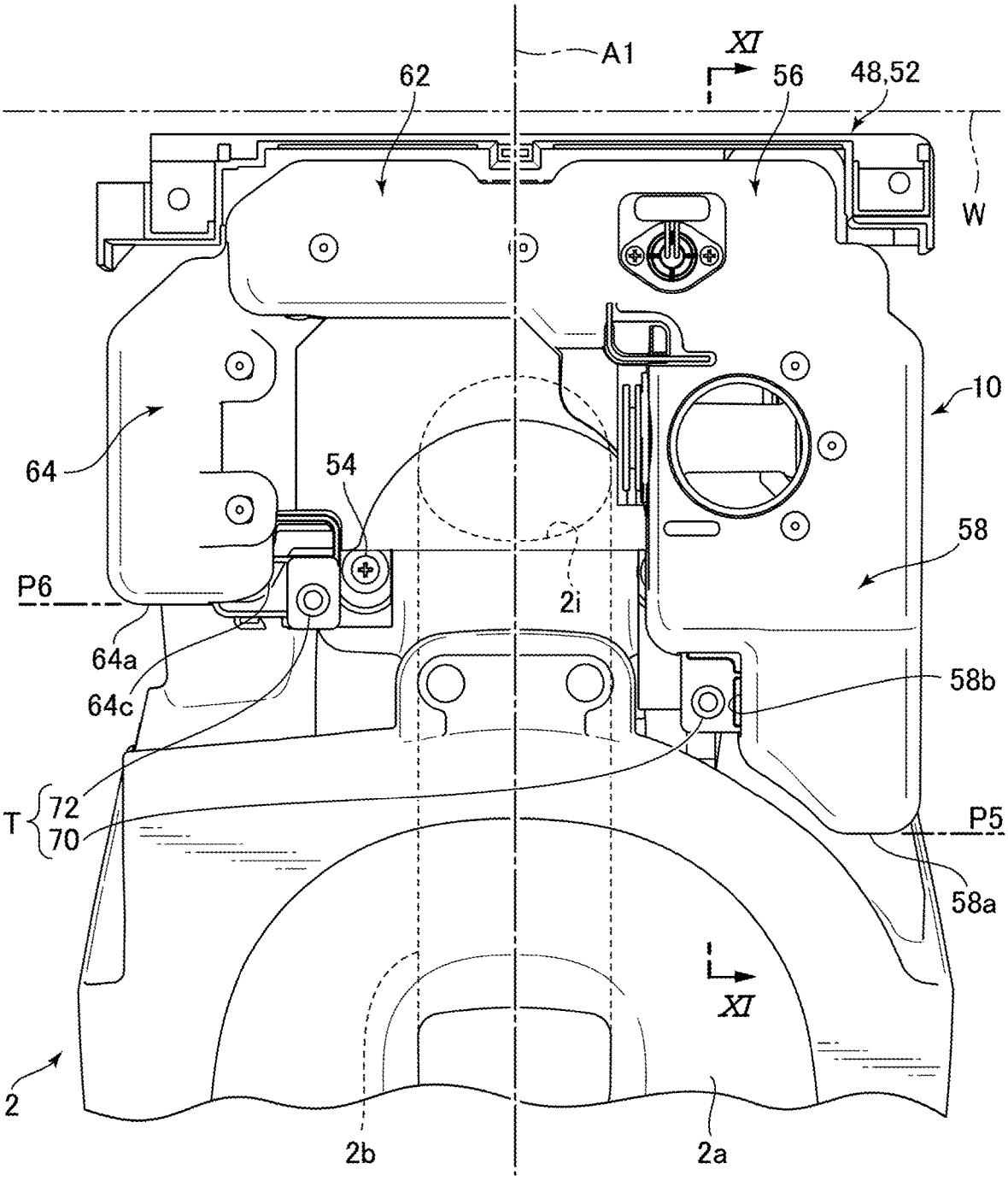
FIG. 9 is a plan view showing a state where the storage tank is attached, via the tank mounting member, to the toilet main body of the flush toilet according to the embodiment of the present invention.

Moreover, FIG. 9 is a plan view showing a state where the storage tank is attached, via the tank mounting member, to the toilet main body of the flush toilet according to the embodiment of the present invention.

First, as shown in FIG. 4 and FIGS. 7 to 9, the tank mounting member 48 includes a base (a base plate 50) that is to be fixed behind the bowl 2*a* of the toilet main body 2, and a rear surface-side supporting plate 52 extending upward from a rear end of the base plate 50.

Furthermore, in plan views in FIGS. 8 and 9, the discharge trap pipe 2*b* of the toilet main body 2 extends in a front-back direction from an inlet 2*h* of the discharge trap pipe 2*b* connected to a lower part of the bowl 2*a* of the toilet main body 2 to an outlet 2*i* behind the bowl 2*a*.

Then, as shown in FIGS. 4, 7 and 8, a supporting surface 2*j* that is made of ceramics and to which the base plate 50 is to be fixed is formed at an upper part and on lateral sides of the discharge trap pipe 2*b* of the toilet main body 2, above the outlet 2*i* of the discharge trap pipe 2*b*.

Accordingly, the base plate 50 is fixed from above with a plurality (four) of screws 54 while being supported by the supporting surface 2*j* behind the toilet main body 2 from below.

Furthermore, as shown in FIGS. 8 and 9, in a state where the tank mounting member 48 is fixed to the toilet main body 2, the rear surface-side supporting plate 52 is disposed adjacent to an external wall surface W on a rear side.

Figure 10:
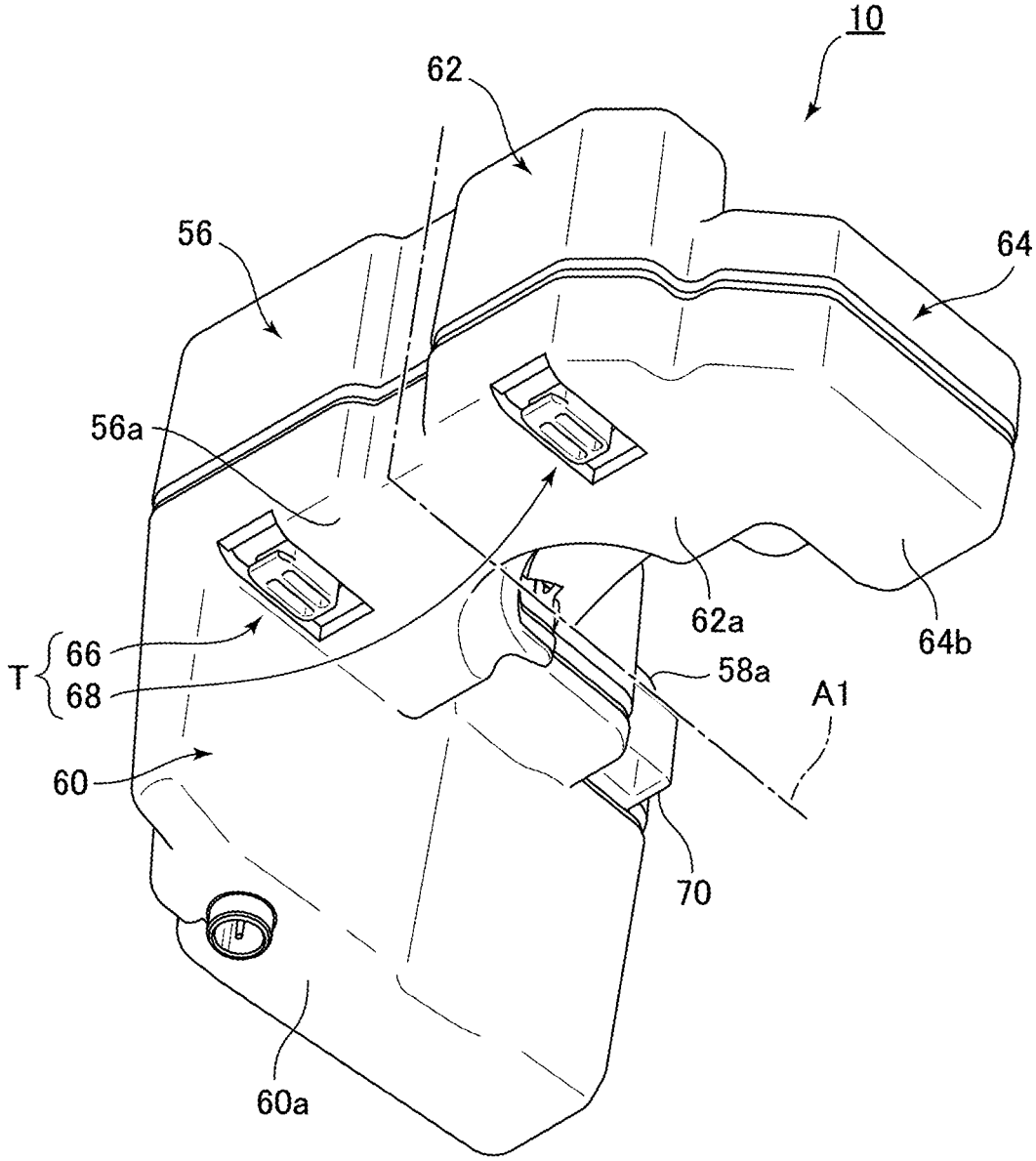
FIG. 10 is a perspective view of the storage tank of the flush toilet according to the embodiment of the present invention, where the storage tank is seen obliquely from behind and below.
Figure 11:
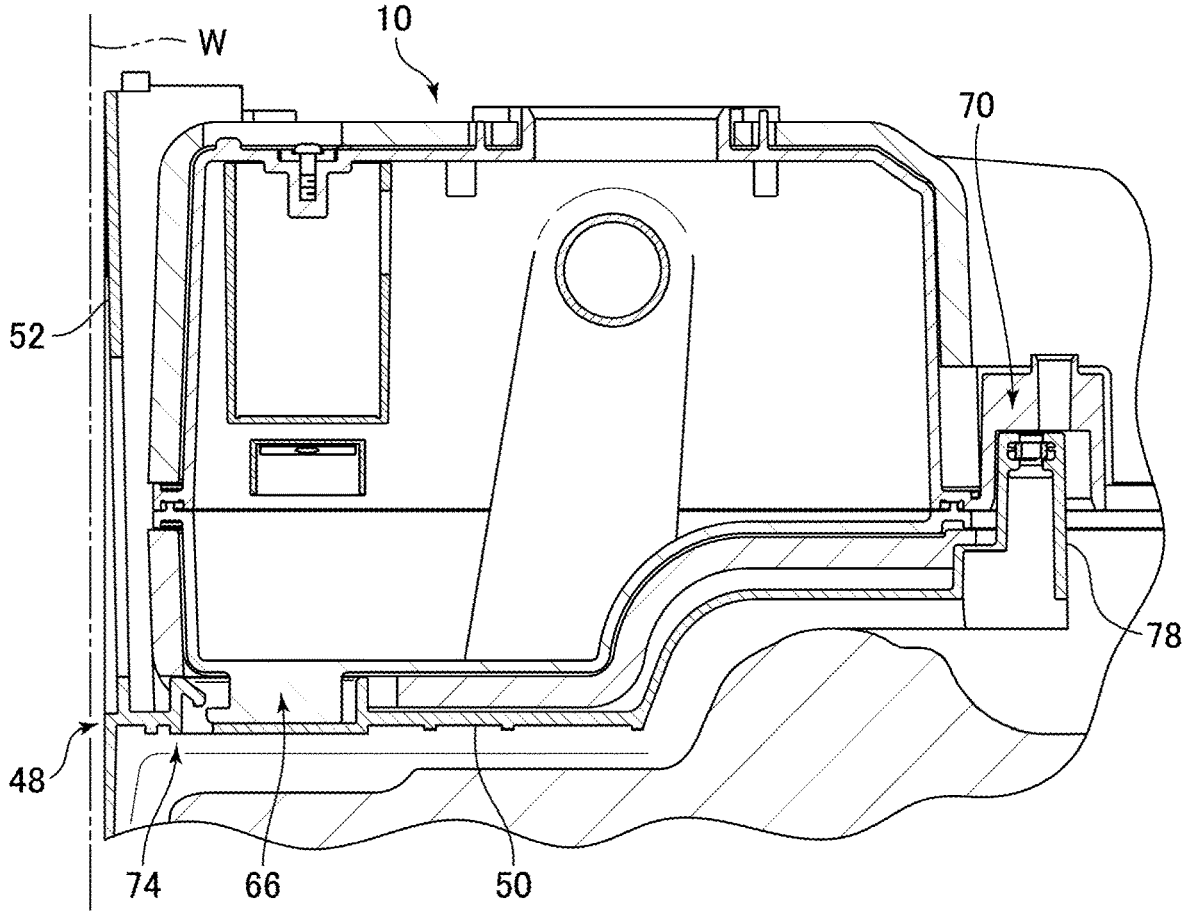
FIG. 11 is a cross-sectional view taken along a line XI-XI in FIG. 9, and is an enlarged partial cross-sectional view showing parts corresponding to the storage tank and the tank mounting member behind the toilet main body in an enlarged manner.

Next, FIG. 10 is a perspective view of the storage tank of the flush toilet according to the embodiment of the present invention, where the storage tank is seen obliquely from behind and below. Furthermore, FIG. 11 is an enlarged partial view showing a part corresponding to the attaching portion of the storage tank of the flush toilet according to the embodiment of the present invention shown in FIG. 10.

First, as shown in FIGS. 9 and 10, the large tank section 44 of the storage tank 10 includes a rear large tank section 56 disposed behind the discharge trap pipe 2*b*, a front large tank section 58 extending forward from the rear large tank section 56 while being disposed on the one of the left and right sides of the discharge trap pipe 2*b* (the right side when the toilet main body 2 is seen from the front), and a lower large tank section 60 extending downward from the rear large tank section 56.

Next, as shown in FIGS. 9 and 10, the small tank section 46 of the storage tank 10 includes a rear small tank section 62 disposed behind the discharge trap pipe 2*b*, and a front small tank section 64 extending forward from the rear small tank section 62 while being disposed on the other one of the left and right sides of the discharge trap pipe 2*b* (the left side when the toilet main body 2 is seen from the front).

Furthermore, as shown in FIGS. 9 and 10, a position P5 of a front end 58*a* of the front large tank section 58 is positioned more forward than a position P6 of a front end 64*a* of the front small tank section 64.

Moreover, as shown in FIGS. 4 and 10, a bottom surface 60*a* of the lower large tank section 60 is located below a bottom surface 62*a* of the rear small tank section 62 and a bottom surface 64*b* of the front small tank section 64.

Next, FIG. 11 is a cross-sectional view taken along a line XI-XI in FIG. 9, and is an enlarged partial cross-sectional view showing parts corresponding to the storage tank and the tank mounting member behind the toilet main body in an enlarged manner.

First, as shown in FIG. 7 and FIGS. 9 to 11, the attaching portion T of the storage tank 10 includes, on a bottom surface 56*a* of the rear large tank section 56 of the storage tank 10 and the bottom surface 62*a* of the rear small tank section 62, a pair of left and right large tank-side attaching portion (a rear attaching portion 66) and a small tank-side attaching portion (a rear attaching portion 68).

Furthermore, as shown in FIG. 7 and FIGS. 9 to 11, the attaching portion T of the storage tank 10 further includes, on a part of an inner side surface 58*b* of the front large tank section 58 of the storage tank 10 and a part of an inner side surface 64*c* of the front small tank section 64, a pair of left and right large tank-side attaching portion (a front attaching portion 70) and a small tank-side attaching portion (a front attaching portion 72).

As shown in FIGS. 7, 8 and 11, the attachment-receiving portion U of the tank mounting member 48 includes a pair of left and right rear attachment-receiving portions 74, 76 that are provided on a rear side on the base plate 50 of the tank mounting member 48. The rear attaching portions 66, 68 of the storage tank 10 can be attached to the corresponding attachment-receiving portions 74, 76 from above.

Furthermore, as shown in FIGS. 7, 8 and 11, the attachment-receiving portion U of the tank mounting member 48 further includes a pair of left and right front attachment-receiving portions 78, 80 that are provided on a front side of the base plate 50 of the tank mounting member 48. The front attaching portions 70, 72 of the storage tank 10 can be attached to the corresponding attachment-receiving portions 78, 80 from above.

Additionally, the attaching portions 66, 70 of the storage tank 10 and the attachment-receiving portions 74, 78 of the tank mounting member 48 shown in FIG. 11 are in a state where the attaching portions 66, 70 of the storage tank are attached and engaged with the corresponding attachment-receiving portions 74, 78 of the tank mounting member 48 from above but are not yet fixed to each other.

Figure 12:
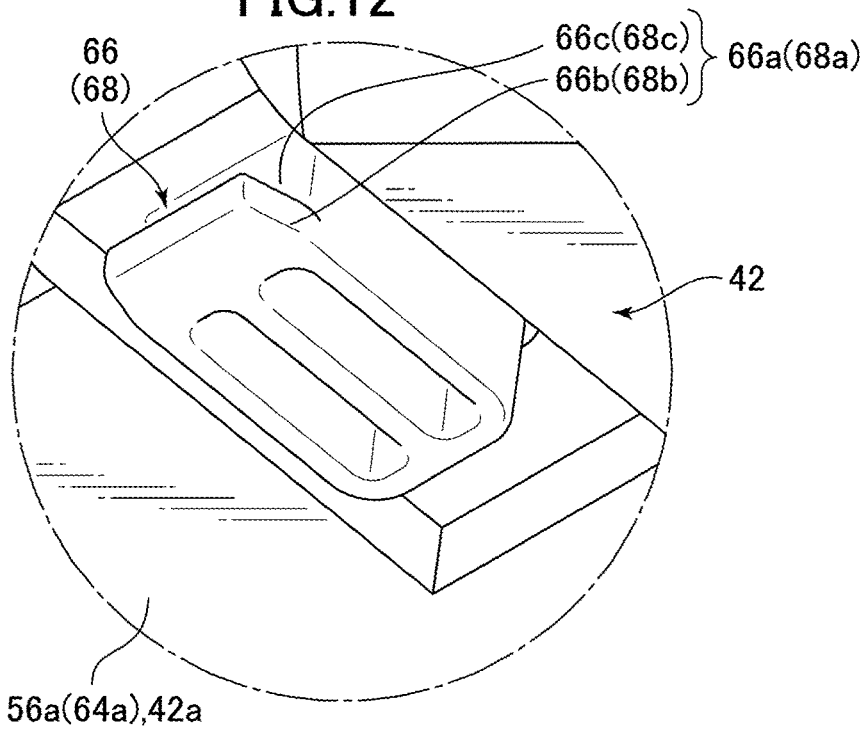
FIG. 12 is an enlarged partial view showing a part of the flush toilet according to the embodiment of the present invention in an enlarged manner, the part corresponding to an attaching portion of the storage tank shown in FIG. 10.

Next, FIG. 12 is an enlarged partial view showing a part of the flush toilet according to the embodiment of the present invention in an enlarged manner, the part corresponding to the attaching portion of the storage tank shown in FIG. 10.

Figure 13A:
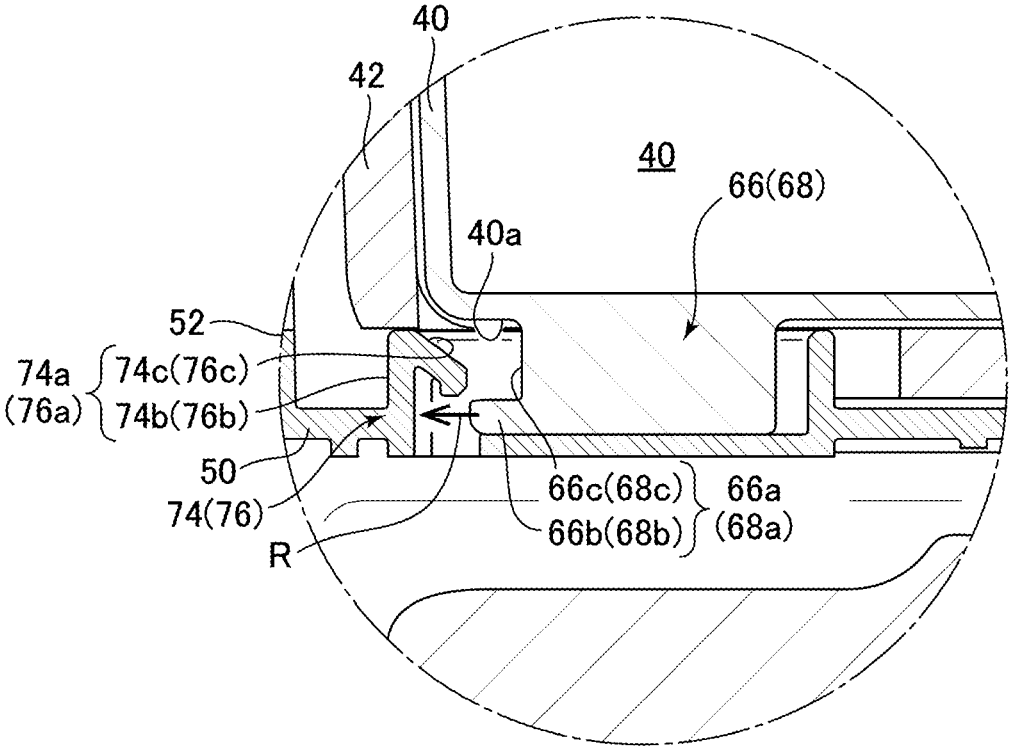
FIG. 13A is an enlarged partial cross-sectional view showing a part of the flush toilet according to the embodiment of the present invention shown in FIG. 11 in an enlarged manner, the part corresponding to a rear attaching portion of the storage tank and a rear attachment-receiving portion of the tank mounting member, FIG. 13A showing a state before the rear attaching portion of the storage tank is moved rearward after being engaged with the rear attachment-receiving portion of the tank mounting member from above (a pre-positioning state)

Furthermore, FIG. 13A is an enlarged partial cross-sectional view showing a part of the flush toilet according to the embodiment of the present invention shown in FIG. 11 in an enlarged manner, the part corresponding to the rear attaching portion of the storage tank and the rear attachment-receiving portion of the tank mounting member, FIG. 13A showing a state before the rear attaching portion of the storage tank is moved rearward after being engaged with the rear attachment-receiving portion of the tank mounting member from above (a pre-positioning state).

Figure 13B:
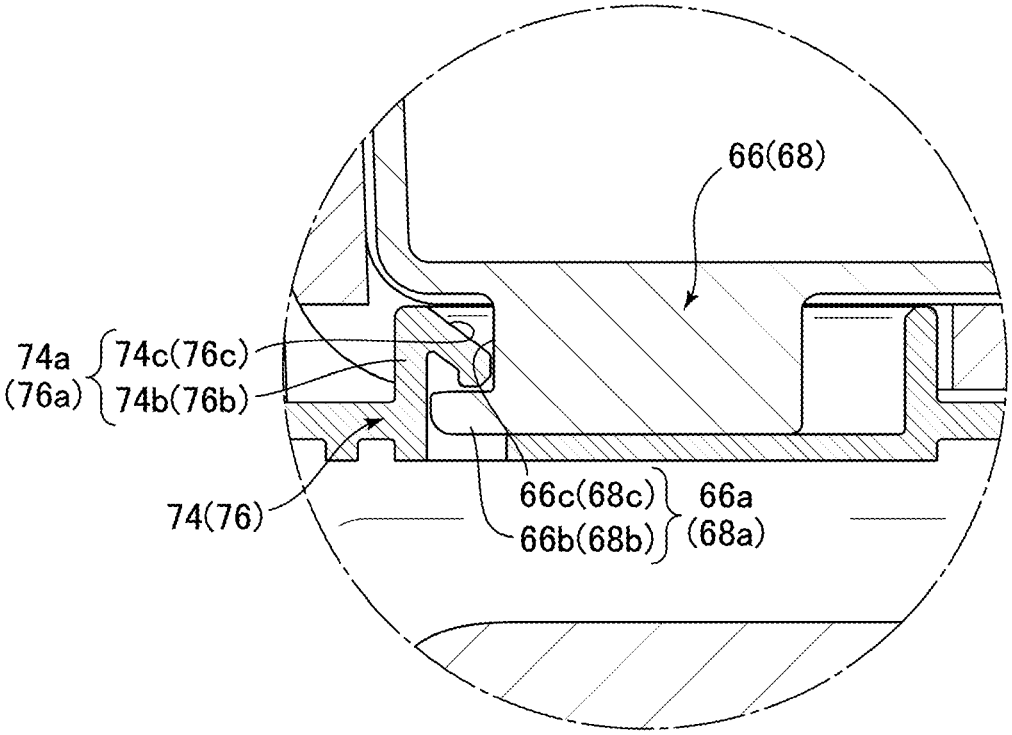
FIG. 13B is, like FIG. 13A, an enlarged partial cross-sectional view showing a part of the flush toilet according to the embodiment of the present invention in an enlarged manner, the part corresponding to the rear attaching portion of the storage tank and the rear attachment-receiving portion of the tank mounting member, FIG. 13B showing a state where the rear attaching portion of the storage tank is moved rearward after being engaged with the rear attachment-receiving portion of the tank mounting member from above and positioning is completed (a positioning completion state)

FIG. 13B is, like FIG. 13A, an enlarged partial cross-sectional view, and shows a state where the rear attaching portion of the storage tank is moved rearward after being engaged with the rear attachment-receiving portion of the tank mounting member from above and positioning is completed (a positioning completion state).

First, as shown in FIGS. 12, 13A and 13B, each rear attaching portion 66, 68 of the storage tank 10 protrudes downward from the bottom surface 40*a* of the tank main body 40, and a lower end thereof is a foot portion that can come into contact with a bottom surface inside the corresponding rear attachment-receiving portion 74, 76 of the tank mounting member 48.

Furthermore, the antisweat material 42 is cut out around each rear attaching portion 66, 68 of the storage tank 10, and the lower end of each rear attaching portion 66, 68 (a bottom surface of the foot portion) is at a position that is slightly lower than the bottom surface 56*a*, 62*a* of the storage tank 10 (a bottom surface 42*a* of the antisweat material 42).

Furthermore, a locking portion (an attaching-side locking portion 66*a*, 68*a*) to be locked with the corresponding rear attachment-receiving portion 74, 76 of the tank mounting member 48 is provided at a lower end portion (the foot portion) of the corresponding rear attaching portion 66, 68.

As shown in FIGS. 13A and 13B, each rear attachment-receiving portion 74, 76 of the tank mounting member 48 is formed into a concave shape so as to be able to wholly receive the corresponding rear attaching portion 66, 68 of the storage tank 10 from above, and a locking portion (an attachment receiving-side locking portion 74*a*, 76*a*) that can be locked together with the corresponding attaching-side locking portion 66*a*, 68*a* of the rear attaching portion 66, 68 of the storage tank 10 is provided on a rear side of the rear attachment-receiving portion 74, 76.

Next, as shown in FIGS. 12, 13A and 13B, each locking portion 66*a*, 68*a* of the storage tank 10 includes a locking projection 66*b*, 68*b* protruding rearward from a rear end of a bottom portion of the corresponding attaching portion 66, 68, and a locking concave portion 66*c*, 68*c* that is formed between the locking projection 66*b*, 68*b* and the bottom surface 40*a* of the tank main body 40 above.

Furthermore, as shown in FIGS. 13A and 13B, each locking portion 74*a*, 76*a* of the tank mounting member 48 includes a locking projection 74*b*, 76*b* that protrudes upward from near a rear end of the base plate 50.

As shown in FIG. 13A, when the storage tank 10 is attached from above to the tank mounting member 48 fixed behind the toilet main body 2, the bottom surfaces of the rear attaching portions 66, 68 of the storage tank 10 come into contact and become engaged with the bottom surfaces of the corresponding rear attachment-receiving portions 74, 76 of the tank mounting member 48 from above.

However, as shown in FIG. 13A, because the attaching-side locking portions 66*a*, 68*a* of the rear attaching portions 66, 68 of the storage tank 10 are not locked with the corresponding attachment receiving-side locking portions 74*a*, 76*a* of the rear attachment-receiving portions 74, 76 of the tank mounting member 48, the attaching-side locking portions 66*a*, 68*a* of the rear attaching portions 66, 68 of the storage tank 10 are not positioned relative to the corresponding attachment receiving-side locking portions 74*a*, 76*a* of the attachment-receiving portions 74, 76 of the tank mounting member 48 (a pre-positioning state).

Then, when the storage tank 10 is moved rearward relative to the tank mounting member 48, the rear attaching portions 66, 68 of the storage tank 10 in the state shown in FIG. 13A are moved rearward (in an arrow R direction in FIG. 13A) relative to the corresponding rear attachment-receiving portions 74, 76 of the tank mounting member 48.

Then, as shown in FIG. 13B, the attaching-side locking portions 66*a*, 68*a* of the rear attaching portions 66, 68 of the storage tank 10 are locked with the corresponding attachment receiving-side locking portions 74*a*, 76*a* of the rear attachment-receiving portions 74, 76 of the tank mounting member 48.

That is, as shown in FIG. 13B, rear end portions of the locking projections 66*b*, 68*b* of the attaching-side locking portions 66*a*, 68*a* of the rear attaching portions 66, 68 of the storage tank 10 abut against front surfaces of the corresponding locking projections 74*b*, 76*b* of the attachment receiving-side locking portions 74*a*, 76*a* of the rear attachment-receiving portion 74, 76 of the tank mounting member 48.

At this time, front end portions of the attachment receiving-side locking portions 74*a*, 76*a* of the rear attachment-receiving portions 74, 76 of the tank mounting member 48 are fitted inside the locking concave portions 66*c*, 68*c* of the corresponding attaching-side locking portions 66*a*, 68*a* of the rear attaching portions 66, 68 of the storage tank 10.

As a result, as shown in FIG. 13B, a state is reached where the attaching-side locking portions 66*a*, 68*a* of the rear attaching portions 66, 68 of the storage tank 10 are positioned relative to the corresponding attachment receiving-side locking portions 74*a*, 76*a* of the rear attachment-receiving portions 74, 76 of the tank mounting member 48 (a positioning completion state).

Furthermore, the locking projections 74*b*, 76*b* of the locking portions 74*a*, 76*a* of the rear attachment-receiving portions 74, 76 of the tank mounting member 48 include, respectively, sloping surfaces 74*c*, 76*c* sloping obliquely downward to the front from upper ends of the locking projections 74*b*, 76*b*.

Accordingly, even if, at the time of attachment of the rear attaching portions 66, 68 of the storage tank 10 to the corresponding rear attachment-receiving portions 74, 76 of the tank mounting member 48 from above, the attaching-side locking portions 66*a*, 68*a* of the rear attaching portions 66, 68 of the storage tank 10 are placed on top of the sloping surfaces 74*c*, 76*c* or the upper ends of the locking projections 74*b*, 76*b* of the attachment-receiving portions 74, 76 of the tank mounting member 48 from above, the sloping surfaces 74*c*, 76*c* may function as guiding surfaces for guiding the corresponding locking portions 66*a*, 68*a* of the attaching portions 66, 68 of the storage tank 10 from the back to ranges inside the attachment-receiving portions 74, 76 of the tank mounting member 48 in front.

Figure 14A:
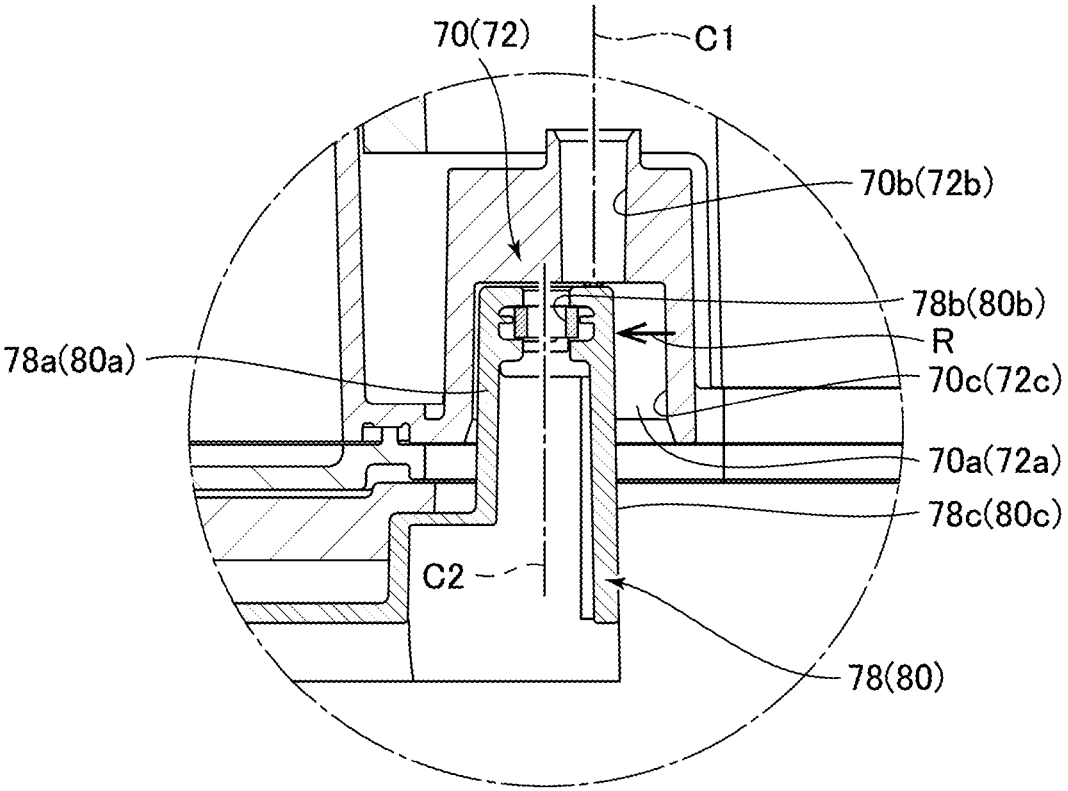
FIG. 14A is an enlarged partial cross-sectional view showing a part of the flush toilet according to the embodiment of the present invention shown in FIG. 11 in an enlarged manner, the part corresponding to a front attaching portion of the storage tank and a front attachment-receiving portion of the tank mounting member, FIG. 14A showing a state before the front attaching portion of the storage tank is moved rearward after being engaged with the front attachment-receiving portion of the tank mounting member from above (a pre-positioning state)

Next, FIG. 14A is an enlarged partial cross-sectional view showing a part of the flush toilet according to the embodiment of the present invention shown in FIG. 11 in an enlarged manner, the part corresponding to the front attaching portion of the storage tank and the front attachment-receiving portion of the tank mounting member, FIG. 14A showing a state before the front attaching portion of the storage tank is moved rearward after being engaged with the front attachment-receiving portion of the tank mounting member from above (a pre-positioning state).

Figure 14B:
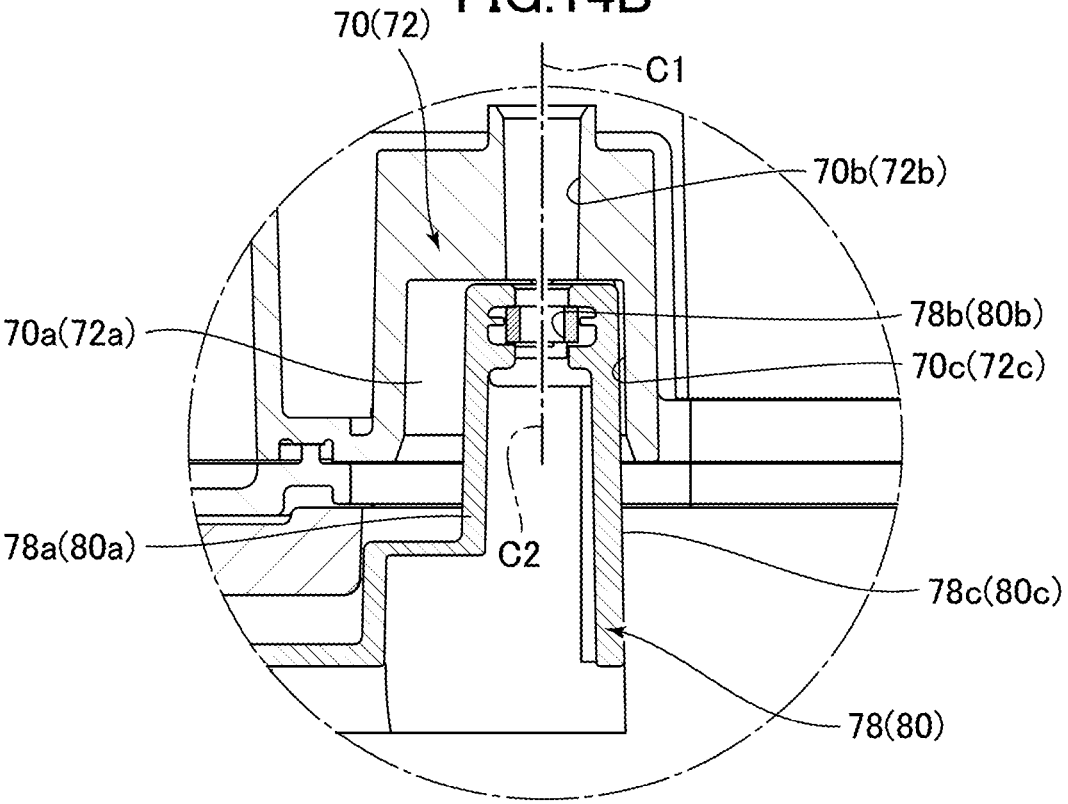
FIG. 14B is, like FIG. 14A, an enlarged partial cross-sectional view showing a part of the flush toilet according to the embodiment of the present invention in an enlarged manner, the part corresponding to the front attaching portion of the storage tank and the front attachment-receiving portion of the tank mounting member, FIG. 14B showing a state where the front attaching portion of the storage tank is moved rearward after being engaged with the front attachment-receiving portion of the tank mounting member from above and positioning is completed (a positioning completion state).

FIG. 14B is, like FIG. 14A, an enlarged partial cross-sectional view, and shows a state where the front attaching portion of the storage tank is moved rearward after being engaged with the front attachment-receiving portion of the tank mounting member from above and positioning is completed (a positioning completion state).

As shown in FIGS. 14A and 14B, each front attaching portion 70, 72 of the storage tank 10 and the corresponding front attachment-receiving portion 78, 80 of the tank mounting member 48 are screw-fixing portions that can be screw-fixed to each other (hereinafter referred to as "the screw-fixing portion(s) 70, 72 of the storage tank 10" and "the screw-fixing portion(s) 78, 80 of the tank mounting member 48").

Specifically, as shown in FIGS. 14A and 14B, the screw-fixing portions 78, 80 of the tank mounting member 48 include protruding portions 78*a*, 80*a* protruding upward from both left and right sides in a front region of the base plate 50, and screw holes (lower screw holes 78*b*, 80*b*) penetrating the protruding portions 78*a*, 80*a* in an up-down direction.

As shown in FIGS. 14A and 14B, fitting concave portions 70*a*, 72*a* where the protruding portions 78*a*, 80*a* of the screw-fixing portions 78, 80 of the tank mounting member 48 can be inserted from below are provided below the screw-fixing portions 70, 72 of the storage tank 10.

Furthermore, the fitting concave portions 70*a*, 72*a* of the storage tank 10 are formed larger than a dimension of the protruding portions 78*a*, 80*a* of the screw-fixing portions 78, 80 of the tank mounting member 48 in the front-back direction.

Accordingly, in a state where the fitting concave portions 70*a*, 72*a* of the storage tank 10 are fitted (engaged) with the corresponding protruding portions 78*a*, 80*a* of the screw-fixing portions 78, 80 of the tank mounting member 48, the screw-fixing portions 70, 72 of the storage tank 10 are capable of sliding in the front-back direction relative to the corresponding screw-fixing portions 78, 80 of the tank mounting member 48.

Furthermore, screw holes (upper screw holes 70*b*, 72*b*) penetrating in the up-down direction are formed above the corresponding fitting concave portions 70*a*, 72*a* of the screw-fixing portions 70, 72 of the storage tank 10.

As shown in FIG. 14A, in a state where the front attaching portions 70, 72 of the storage tank 10 are attached and engaged with the corresponding front attachment-receiving portions 78, 80 of the tank mounting member 48 from above but are not yet moved rearward (the pre-positioning state), front ends 70*c*, 72*c* of the fitting concave portions 70*a*, 72*a* of the screw-fixing portions 70, 72 of the storage tank 10 are separate from front ends 78*c*, 80*c* of the protruding portions 78*a*, 80*a* of the screw-fixing portions 78, 80 of the tank mounting member 48.

At this time, as shown in FIG. 14A, a central axis C1 of the upper screw holes 70*b*, 72*b* of the screw-fixing portions 70, 72 of the storage tank 10 is at a position more forward than a central axis C2 of the lower screw holes 78*b*, 80*b* of the screw-fixing portions 78, 80 of the tank mounting member 48, and the upper screw holes 70*b*, 72*b* do not coincide with the corresponding lower screw holes 78*b*, 80*b*.

Then, when the storage tank 10 is moved rearward relative to the tank mounting member 48, the screw-fixing portions 70, 72 of the storage tank 10 in the state shown in FIG. 14A move rearward (in the arrow R direction in FIG. 14A) relative to the corresponding rear attachment-receiving portions 74, 76 of the tank mounting member 48.

As shown in FIG. 14B, the front ends 70*c*, 72*c* of the fitting concave portions 70*a*, 72*a* of the screw-fixing portions 70, 72 of the storage tank 10 thus abut against the corresponding front ends 78*c*, 80*c* of the protruding portions 78*a*, 80*a* of the screw-fixing portions 78, 80 of the tank mounting member 48.

At this time, as shown in FIG. 14B, the central axis C1 of the upper screw holes 70*b*, 72*b* of the screw-fixing portions 70, 72 of the storage tank 10 coincides with the central axis C2 of the corresponding lower screw holes 78*b*, 80*b* of the screw-fixing portions 78, 80 of the tank mounting member 48, and positioning of the screw-fixing portions 70, 72 of the storage tank 10 and the screw-fixing portions 78, 80 of the tank mounting member 48 is completed.

Then, when common screw members (not shown) are fastened into the coinciding upper screw holes 70*b*, 72*b* and lower screw holes 78*b*, 80*b*, the screw-fixing portions 70, 72 of the storage tank 10 are fixed to the screw-fixing portions 78, 80 of the tank mounting member 48.

Next, an effect of the flush toilet 1 according to the embodiment of the present invention described above will be described with reference to FIGS. 1 to 14B.

With the flush toilet 1 according to the present embodiment, at the time of installing the storage tank 10 of the tank device 4 on the toilet main body 2, the tank mounting member 48 is first fixed behind the bowl 2*a* of the toilet main body 2. Then, the storage tank 10 is attached from above to the tank mounting member 48 that is fixed to the toilet main body 2.

At this time the attaching portions 66, 68, 70, 72 of the storage tank 10 may be caused to be engaged with the attachment-receiving portions 74, 76, 78, 80 of the tank mounting member 48 by lowering the storage tank 10 onto the base (the base plate 50) of the tank mounting member 48 from above.

Then, when the storage tank 10 is moved, after engagement, in a horizontal direction relative to the tank mounting member 48, the attaching portions 66, 68, 70, 72 of the storage tank 10 may be easily positioned and fixed to the attachment-receiving portions 74, 76, 78, 80 of the tank mounting member 48.

Furthermore, because the attaching portions 66, 68, 70, 72 of the storage tank 10 can be easily positioned relative to the attachment-receiving portions 74, 76, 78, 80 of the tank mounting member 48 simply by moving the storage tank 10 in the horizontal direction relative to the tank mounting member 48, the number of fixing parts (screw members or the like) to be fixed to each other may be reduced.

Accordingly, a space occupied by an attachment structure, namely, the attaching portions 66, 68, 70, 72 of the storage tank 10 and the attachment-receiving portions 74, 76, 78, 80 of the tank mounting member 48, may be reduced, and thus, a limited installation space behind the toilet main body, above the floor surface, may be effectively used, and also, the size (capacity) of the storage tank 10 may be made large. Furthermore, because the number of fixing parts is reduced, a construction task is facilitated.

Furthermore, with the flush toilet 1 according to the present embodiment, in a state where the attaching portions 66, 68, 70, 72 of the storage tank 10 are engaged with the attachment-receiving portions 74, 76, 78, 80 of the tank mounting member 48, horizontally moving the storage tank 10 in the front-back direction relative to the tank mounting member 48 enables the attaching portions 66, 68, 70, 72 of the storage tank 10 to be positioned at fixable positions of the corresponding attachment-receiving portions 74, 76, 78, 80 of the tank mounting member 48 while avoiding interference to the discharge trap pipe 2*b* extending in the front-back direction.

Moreover, the storage tank 10 may be fixed to the tank mounting member 48 in a state where the storage tank 10 is disposed in a manner surrounding an upper portion of the discharge trap pipe 2*b* from both the left and right sides and from behind, and thus, a space behind the toilet main body 2 may be effectively used as the installation space for the storage tank 10.

Furthermore, as shown in FIGS. 9 and 11, with the flush toilet 1 according to the present embodiment, in a state where the attaching portions 66, 68, 70, 72 of the storage tank 10 are fixed to the corresponding attachment-receiving portions 74, 76, 78, 80 of the tank mounting member 48, a rear surface of the storage tank 10 may be positioned close to the rear surface-side supporting plate 52 of the tank mounting member 48 on a rear side of the rear surface.

Accordingly, a gap between the external wall surface W that is adjacent, on a rear side, to a rear surface of the rear surface-side supporting plate 52 and the rear surface of the storage tank 10 may be reduced.

Therefore, the rear surface and a rear end of the storage tank 10 that is installed in the installation space behind the toilet main body 2 may be positioned as rearward (to the external wall surface W side) as possible, and an installation space may be secured for the storage tank 10 and other peripheral units behind the toilet main body 2.

Therefore, the freedom of design of the storage tank 10 may be increased while effectively using the limited space behind the toilet main body 2, and a large tank capacity may be secured.

On the other hand, for example, at the time of performing a task such as maintenance of the storage tank 10, the storage tank 10 may be moved forward after releasing fixation between the attaching portions 66, 68, 70, 72 of the storage tank 10 and the corresponding attachment-receiving portions 74, 76, 78, 80 of the tank mounting member 48.

Accordingly, because the rear surface of the storage tank 10 may be separated from the rear surface-side supporting plate 52 or the external wall surface W on the rear side of the rear surface, the rear surface side of the storage tank 10 may be easily accessed.

Furthermore, because engagement between the attaching portions 66, 68, 70, 72 of the storage tank 10 and the corresponding attachment-receiving portions 74, 76, 78, 80 of the tank mounting member 48 is released by pulling the storage tank 10 upward, the storage tank 10 may be removed from the tank mounting member 48.

The ease of work at the time of maintenance of the storage tank 10 may thus be increased.

Furthermore, with the flush toilet 1 according to the present embodiment, because the storage tank 10 has a deformed shape that is left-right asymmetrical, the attaching portions 66, 68, 70, 72 of the storage tank 10 may be positioned at fixable positions of the corresponding attachment-receiving portions 74, 76, 78, 80 of the tank mounting member 48 while avoiding interference to the discharge trap pipe 2*b* extending in the front-back direction.

Furthermore, because the storage tank 10 has a deformed shape that is left-right asymmetrical, the storage tank 10 may be fixed to the tank mounting member 48 in a state where the storage tank 10 is disposed in a manner surrounding the upper portion of the discharge trap pipe 2*b* from both the left and right sides and from behind. A space behind the toilet main body 2 may thus be effectively used as the installation space for the storage tank 10.

Moreover, because the attaching portions 66, 68, 70, 72 of the storage tank 10 are provided in left and right pairs at the large tank section 44 and the small tank section 46 of the storage tank 10, the storage tank 10 may be stably attached to the tank mounting member 48 even though the storage tank 10 has a deformed shape that is left-right asymmetrical.

Furthermore, with the flush toilet 1 according to the present embodiment, the shape of the storage tank 10 is a deformed shape that is left-right asymmetrical because of the rear large tank section 56, the front large tank section 58 and the lower large tank section 60 of the large tank section 44 of the storage tank 10 and the rear small tank section 62 and the front small tank section 64 of the small tank section 46 of the storage tank 10. The storage tank 10 with a relatively large capacity may thus be installed in the limited installation space behind the toilet main body 2.

Furthermore, even with the storage tank 10 having such a deformed shape, the large tank-side attaching portions 66, 78 of the storage tank 10 are provided on the rear large tank section 56 and the front large tank section 58, respectively, and the small tank-side attaching portions 68, 80 of the storage tank are provided on the rear small tank section 62 and the front small tank section 64, respectively. Accordingly, the attaching portions 66, 68, 70, 72 of the storage tank 10 may be stably attached to the corresponding attachment-receiving portions 74, 76, 78, 80 of the tank mounting member 48.

Furthermore, because the shape of the storage tank 10 is a deformed shape that is left-right asymmetrical, the attaching portions 66, 68, 70, 72 of the storage tank 10 may be securely fixed after being positioned at the fixable positions of the corresponding attachment-receiving portions 74, 76, 78, 80 of the tank mounting member 48 while avoiding interference to the discharge trap pipe 2*b* extending in the front-back direction.

Moreover, with the flush toilet 1 according to the present embodiment, even when the shape of the storage tank 10 is a deformed shape that is left-right asymmetrical, the storage tank 10 may be horizontally moved in the front-back direction relative to the tank mounting member 48 in a state where the large tank-side attaching portions 66, 78 and the small tank-side attaching portions 68, 80 of the storage tank 10 are engaged with the corresponding attachment-receiving portions 74, 76, 78, 80 of the tank mounting member 48. Accordingly, the screw-fixing portions of the front attaching portions 70, 72 of the storage tank 10 and the front attachment-receiving portions 78, 80 of the tank mounting member 48 (the upper screw holes 70*b*, 72*b* and the lower screw holes 78*b*, 80*b*) may be aligned with each other in advance.

Accordingly, screw-fixing may be accurately performed for the screw-fixing portions (the upper screw holes 70*b*, 72*b* and the lower screw holes 78*b*, 80*b*) that are aligned, and erroneous construction may be avoided.

Furthermore, with the flush toilet 1 according to the present embodiment, even when the shape of the storage tank 10 is a deformed shape that is left-right asymmetrical, the locking portions (the attaching-side locking portions 66*a*, 68*a*) of the rear attaching portions 66, 68 of the storage tank 10 may be locked and fixed to the corresponding locking portions (the attachment receiving-side locking portions 74*a*, 76*a*) of the rear attachment-receiving portions 74, 76 of the tank mounting member 48 by the storage tank 10 being moved rearward relative to the tank mounting member 48 in a state where the attaching portions 66, 68, 70, 72 of the storage tank 10 are engaged with the corresponding attachment-receiving portions 74, 76, 78, 80 of the tank mounting member 48.

Furthermore, locking of the locking portions (the attaching-side locking portions 66*a*, 68*a* and the attachment receiving-side locking portions 74*a*, 76*a*) allows the screw-fixing portions of the front attaching portions 70, 72 of the storage tank 10 and the front attachment-receiving portions 78, 80 of the tank mounting member 48 (the upper screw holes 70*b*, 72*b* and the lower screw holes 78*b*, 80*b*) to be swiftly and accurately aligned before fixing.

Moreover, screw-fixing may be swiftly and accurately performed for the screw-fixing portions (the upper screw holes 70*b*, 72*b* and the lower screw holes 78*b*, 80*b*) that are aligned, and thus, the ease of construction may be increased.

Furthermore, with the flush toilet 1 according to the present embodiment, even if, at the time of attachment of the rear attaching portions 66, 68 of the storage tank 10 to the corresponding rear attachment-receiving portions 74, 76 of the tank mounting member 48 from above, the bottom surfaces of the rear attaching portions 66, 68 of the storage tank 10 are placed on top of the sloping surfaces 74, 76*c* or the upper ends of the locking projections 74*b*, 76*b* of the locking portions 74*a*, 76*a* of the rear attachment-receiving portions 74, 76 of the tank mounting member 48 from above, the rear attaching portions 66, 68 of the storage tank 10 may be caused to move on the sloping surfaces 74*c*, 76*c* (the guiding surfaces) of the locking portions 74*a*, 76*a* of the rear attachment-receiving portions 74, 76 of the tank mounting member 48, from the back to obliquely forward and downward.

The rear attaching portions 66, 68 of the storage tank 10 may thereby be guided into ranges in the corresponding rear attachment-receiving portions 74, 76 of the tank mounting member 48 where engagement is possible, and thus, positioning of the rear attaching portions 66, 68 of the storage tank 10 relative to the rear attachment-receiving portions 74, 76 of the tank mounting member 48 may be aided.

Although the present disclosure has been explained with reference to specific, preferred embodiments, one of ordinary skill in the art will recognize that modifications and improvements can be made while remaining within the scope and spirit of the present disclosure. The scope of the present disclosure is determined solely by appended claims.

What is claimed is:

1. A flush toilet for discharging waste by flushing the flush toilet with flush water, the flush toilet comprising:

a toilet main body including a bowl configured to receive waste, and a discharge trap configured to discharge the waste in the bowl; and a tank device configured to supply flush water to the toilet main body, the tank device includes:

a storage tank configured to store the flush water to be supplied to the toilet main body, the storage tank being provided behind the toilet main body, and a tank mounting member fixed behind the bowl of the toilet main body, to which an attaching portion of the storage tank is detachably mounted, wherein the tank mounting member includes a base configured to support the storage tank from below, and an attachment-receiving portion that is provided on the base and to which the attaching portion of the storage tank is detachably attached, and when the storage tank is mounted to the tank mounting member, the attaching portion of the storage tank is configured to engage with the attachment-receiving portion of the tank mounting member by the storage tank being lowered from above onto the base of the tank mounting member from above, and then the attaching portion of the storage tank is configured to be fixed to the attachment-receiving portion of the tank mounting member by the storage tank being moved horizontally with respect to the tank mounting member.

2. The flush toilet according to claim 1, wherein the discharge trap extends in a front-back direction in a plan view, from an inlet that is connected to the bowl to an outlet behind the bowl, and the storage tank is disposed to surround an upper portion of the discharge trap from both left and right sides and from behind by being horizontally moved in the front-back direction in a state where the attaching portion of the storage tank is engaged with the attachment-receiving portion of the tank mounting member, and then the attaching portion of the storage tank is configured to be fixed to the attachment-receiving portion of the tank mounting member.

3. The flush toilet according to claim 2, wherein the attaching portion of the storage tank is configured to be fixed to the attachment-receiving portion of the tank mounting member in a state where a rear surface of the storage tank is disposed close to an external wall surface behind the rear surface by the storage tank being moved rearward in a state where the attaching portion of the storage tank is engaged with the attachment-receiving portion of the tank mounting member.

4. The flush toilet according to claim 1, wherein the storage tank has a left-right asymmetrical shape including a large tank section and a small tank section, the large tank section being a large-capacity side of the storage tank that is divided into two at a center in a left-right direction, the small tank section being a small-capacity side of the storage tank that is divided into two at the center in the left-right direction, and the attaching portion of the storage tank is at least a pair of left and right attaching portions, the left and right attaching portions being provided at the large tank section and the small tank section of the storage tank, respectively.

5. The flush toilet according to claim 4, wherein the attaching portion of the storage tank and the attachment-receiving portion of the tank mounting member include respective screw-fixing portions that are configured to be screw-fixed to each other after the storage tank is moved in the horizontal direction relative to the tank mounting member in a state where the attaching portion of the storage tank is engaged with the attachment-receiving portion of the tank mounting member.

6. The flush toilet according to claim 5, wherein the attaching portion of the storage tank and the attachment-receiving portion of the tank mounting member further include respective locking portions configured to be locked to each other after the storage tank is moved rearward relative to the tank mounting member in a state where the attaching portion of the storage tank is engaged with the attachment-receiving portion of the tank mounting member, and then the locking portions are configured to be enable the screw-fixing portions of the attaching portion of the storage tank and the attachment-receiving portion of the tank mounting member to be fixed to each other.

7. The flush toilet according to claim 6, wherein the locking portion of the attachment-receiving portion of the tank mounting member includes a sloping surface whose rear upper surface slopes downward from back to front.

8. The flush toilet according to claim 4, wherein the large tank section includes a rear large tank section disposed behind the discharge trap, a front large tank section that extends forward from the rear large tank section and that is disposed on one of left and right sides of the discharge trap, and a lower large tank section that extends downward from the rear large tank section, the small tank section includes a rear small tank section that is disposed behind the discharge trap, and a front small tank section that extends forward from the rear small tank section and that is disposed on another one of the left and right sides of the discharge trap, a front end of the front large tank section is disposed more forward than a front end of the front small tank section, a bottom surface of the lower large tank section is located below a bottom surface of each of the rear small tank section and the front small tank section, and the attaching portion of the storage tank includes a large tank-side attaching portion that is provided on at least one of the rear large tank section and the front large tank section, and a small tank-side attaching portion that is provided on at least one of the rear small tank section and the front small tank section.

9. The flush toilet according to claim 8, wherein the large tank-side attaching portion and the small tank-side attaching portion of the storage tank and corresponding attachment-receiving portions of the tank mounting member include respective screw-fixing portions configured to be screw-fixed to each other after the storage tank is horizontally moved in the front-back direction relative to the tank mounting member in a state where the large tank-side attaching portion and the small tank-side attaching portion are engaged with the corresponding attachment-receiving portions of the tank mounting member.

10. The flush toilet according to claim 9, wherein the large tank-side attaching portion and the small tank-side attaching portion of the storage tank and the corresponding attachment-receiving portions of the tank mounting member further include respective locking portions configured to be locked to each other after the storage tank is moved rearward relative to the tank mounting member in a state where the large tank-side attaching portion and the small tank-side attaching portion are engaged with the corresponding attachment-receiving portions of the tank mounting member, and then the respective locking portions are configured to be enable the screw-fixing portions of each attaching portion of the storage tank and the corresponding attachment-receiving portion of the tank mounting member to be fixed to each other.

* * * * *